US011274431B2

(12) United States Patent
McCall

(10) Patent No.: US 11,274,431 B2
(45) Date of Patent: Mar. 15, 2022

(54) TORSION BOX PANEL ASSEMBLY WITH COMPACT CONVEYANCE CONFIGURATION

(71) Applicant: Gerald J. McCall, Rockford, MI (US)

(72) Inventor: Gerald J. McCall, Rockford, MI (US)

( * ) Notice: Subject to any disclaimer, the term of this patent is extended or adjusted under 35 U.S.C. 154(b) by 0 days.

(21) Appl. No.: 16/184,000

(22) Filed: Nov. 8, 2018

(65) Prior Publication Data

US 2019/0136506 A1 May 9, 2019

Related U.S. Application Data

(60) Provisional application No. 62/583,950, filed on Nov. 9, 2017.

(51) Int. Cl.

| | |
|---|---|
| ***E04B 1/344*** | (2006.01) |
| ***E04F 13/10*** | (2006.01) |
| ***E04C 2/36*** | (2006.01) |
| ***E04B 1/61*** | (2006.01) |
| ***E04F 13/08*** | (2006.01) |
| ***B27M 3/00*** | (2006.01) |
| ***E04B 1/343*** | (2006.01) |

(52) U.S. Cl.

CPC ..... *E04B 1/344* (2013.01); *B27M 3/00* (2013.01); *E04B 1/6108* (2013.01); *E04C 2/365* (2013.01); *E04F 13/0871* (2013.01); *E04F 13/10* (2013.01); *E04B 2001/34389* (2013.01)

(58) Field of Classification Search

CPC ..... E04B 31/344; E04B 1/6108; B27M 3/00; B27M 3/0026; B27M 3/0053; E04F 13/0871; E04F 13/10; E04C 2/365; B65D 81/3858

USPC ..... 217/14, 57, 60 R; 229/103.11

See application file for complete search history.

(56) References Cited

U.S. PATENT DOCUMENTS 2,523,145 A * 9/1950 Robinson ..... B65D 81/3862 229/103.11
4,015,392 A * 4/1977 Eaton ..... E04D 1/265 52/533
4,685,837 A * 8/1987 Cicanese ..... E02D 17/08 405/272
5,922,446 A * 7/1999 Piening ..... B64C 3/20 244/123.3

(Continued)

FOREIGN PATENT DOCUMENTS

DE 102008063365 A1 * 7/2010 ..... B65D 71/10

*Primary Examiner* — Brian D Mattei
*Assistant Examiner* — Omar F Hijaz
(74) *Attorney, Agent, or Firm* — Barnes & Thornburg LLP

(57) ABSTRACT

A torsion box panel assembly includes a plurality of sub-panels each having a skin secured to a core, and a plurality of hinges each coupled between a different pair of the sub-panels such that each sub-panel is foldable relative to an adjacent sub-panel along a respective hinge. The hingedly-coupled sub-panels together form a base panel having an expanded configuration in which each hinge is closed and the surfaces of the sub-panel skins are substantially co-planar. The base panel, in its expanded configuration, has a planar panel surface defined, at least in part, by the combination of the co-planar sub-panel skins. At least one stabilizing member is secured to the planar panel surface and spans all of the closed hinges to lock the sub-panels together to form a torsion box panel.

20 Claims, 14 Drawing Sheets

(56) References Cited

U.S. PATENT DOCUMENTS

| | | | | |
|---|---|---|---|---|
| 6,355,337 | B1 * | 3/2002 | Piening | B29C 70/48 428/223 |
| 7,025,019 | B2 * | 4/2006 | Axelrod | A01K 1/0245 119/499 |
| 8,534,003 | B2 * | 9/2013 | Curry, III | E06B 9/0638 52/71 |
| 10,655,324 | B2 * | 5/2020 | Hettler | E04C 2/205 |
| 2014/0091691 | A1 * | 4/2014 | Atwood | A45C 11/16 312/263 |
| 2014/0138486 | A1 * | 5/2014 | Guinaldo Fernadez | B64C 3/18 244/123.1 |
| 2014/0319018 | A1 * | 10/2014 | Collison | B65D 81/127 206/589 |
| 2017/0043922 | A1 * | 2/2017 | Chubb | B65D 19/44 |

* cited by examiner

TORSION BOX PANEL ASSEMBLY WITH COMPACT CONVEYANCE CONFIGURATION

CROSS-REFERENCE TO RELATED APPLICATION

This application claims the benefit of and priority to U.S. Provisional Patent Application Ser. No. 62/583,950, filed Nov. 9, 2017, the disclosure of which is incorporated herein by reference in its entirety.

FIELD OF THE INVENTION

This disclosure relates generally to torsion box panels, and more specifically to torsion box panel assemblies having compact conveyance configurations.

BACKGROUND

Conventional torsion boxes generally include a grid or patterned core to which one or more elongated panels are affixed. Such conventional torsion boxes are typically constructed on site as shipping or other transport of fully constructed torsion boxes can be costly and/or unwieldy due to their size and/or weight.

SUMMARY

The present disclosure may comprise one or more of the features recited in the attached claims, and/or one or more of the following features and combinations thereof. In one aspect, a torsion box panel assembly may comprise a plurality of sub-panels each defining a respective sub-panel length and sub-panel width and each including a first skin having opposed first and second surfaces and a core secured to the first surface of the first skin with the second surface of the secured first skin being planar, a plurality of hinges each coupled between a different pair of the plurality of sub-panels and extending at least partially along the sub-panel lengths thereof, each of the plurality of sub-panels foldable relative to an adjacent one of the plurality of sub-panels along a respective one of the plurality of hinges, wherein the plurality of hingedly-coupled sub-panels forms a base panel having an expanded configuration in which each of the plurality of hinges is closed with the second planar surfaces of the first skins of all of the plurality of sub-panels substantially co-planar, the base panel in its expanded configuration having a base panel width defined by individual lengths of each the plurality of sub-panels, a base panel length defined, at least in part, by a sum of the widths of each of the plurality of sub-panels and a first planar panel surface defined, at least in part, by a combination of the co-planar second planar surfaces of the first skins of each of the plurality of sub-panels, and at least one stabilizing member secured to the first planar panel surface of the base panel in its expanded configuration, the secured at least one stabilizing member spanning all of the plurality of closed hinges to lock the plurality of sub-panels together to form a torsion box panel.

In another aspect, a torsion box panel assembly may comprise a plurality of separate sub-panels each having length and a width and including a first skin secured to a core with each spanning the length and the width of the respective sub-panel such that a major outer surface of the first skin of each of the plurality of sub-panels forms a first planar outer surface of the respective sub-panel, the plurality of sub-panels arranged side-by-side to form abutting or non-abutting interfaces along the respective lengths or widths thereof with the first planar outer surfaces of the plurality of sub-panels all facing a common direction, a plurality of braces each secured to a respective pair of the side-by-side arranged sub-panels to lock the pair of sub-panels together with the first planar outer surfaces thereof co-planar with one another such that the plurality of side-by-side plurality of sub-panels forms a base panel having a first planar panel surface defined by the first planar surfaces of each of the plurality of sub-panels, and at least one finish panel secured to the base panel covering the first planar panel surface thereof.

BRIEF DESCRIPTION OF THE DRAWINGS

This disclosure is illustrated by way of example and not by way of limitation in the accompanying Figures. Where considered appropriate, reference labels have been repeated among the Figures to indicate corresponding or analogous elements.

DETAILED DESCRIPTION OF THE DRAWINGS

Figure 1A:
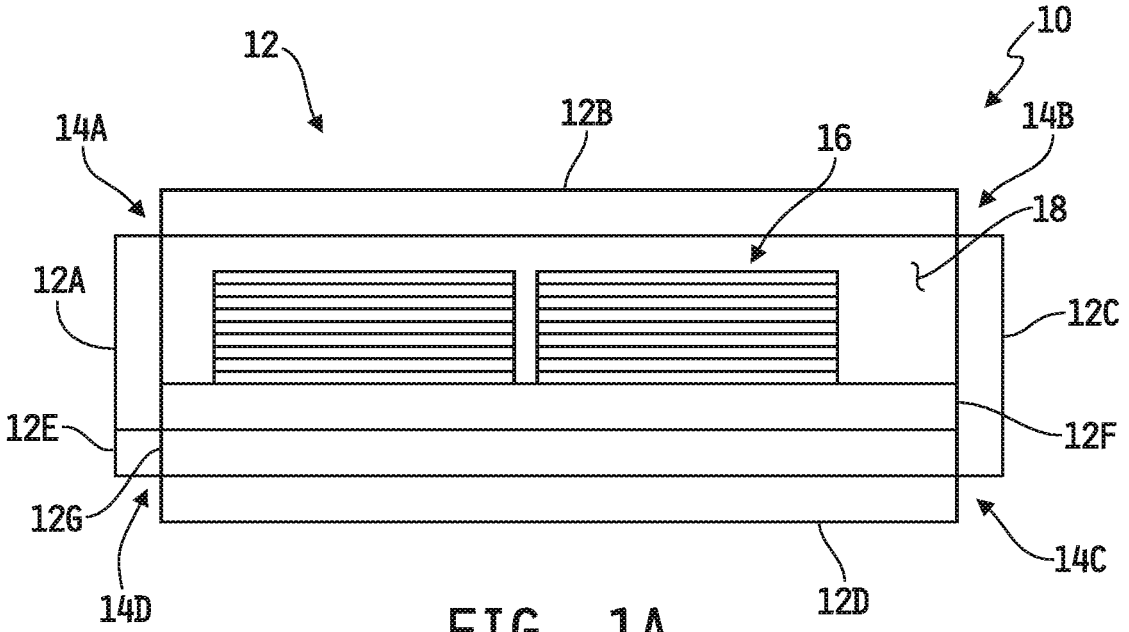
FIG. 1A is a simplified end view of an embodiment of a torsion box panel assembly shown in a compact configuration suitable for transport and/or storage thereof.
Figure 1B:
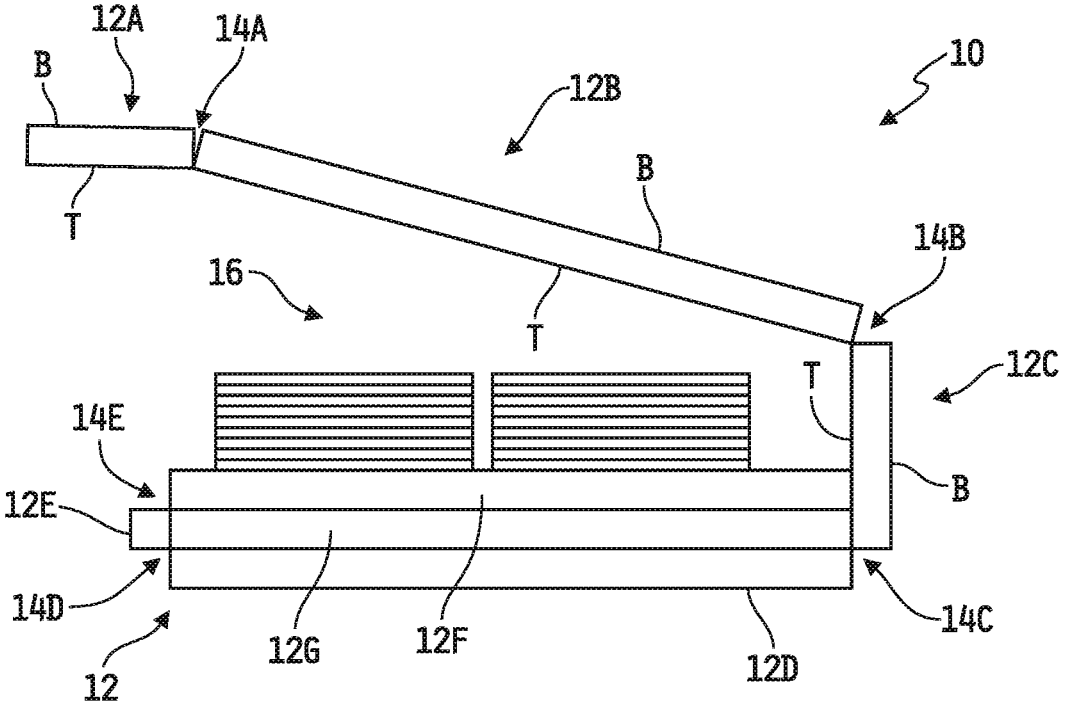
FIG. 1B is a simplified view similar to FIG. 1A showing the base panel of the torsion box panel assembly partially unfolded.
Figure 1C:
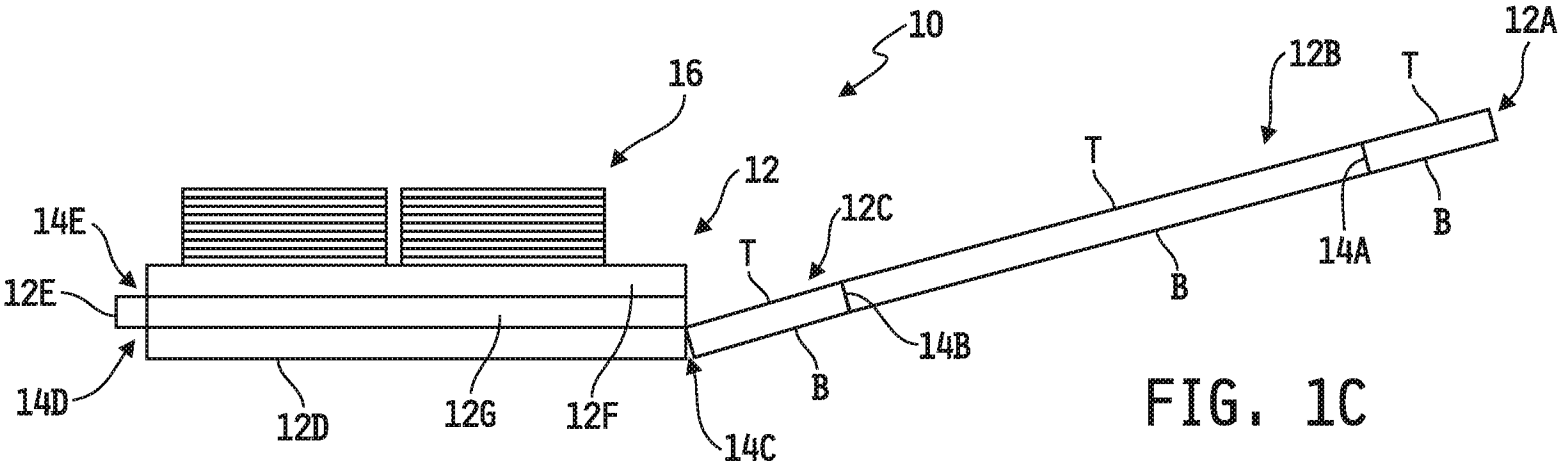
FIG. 1C is a simplified view similar to FIG. 1B showing the base panel of the torsion box panel assembly further partially unfolded.
Figure 1D:
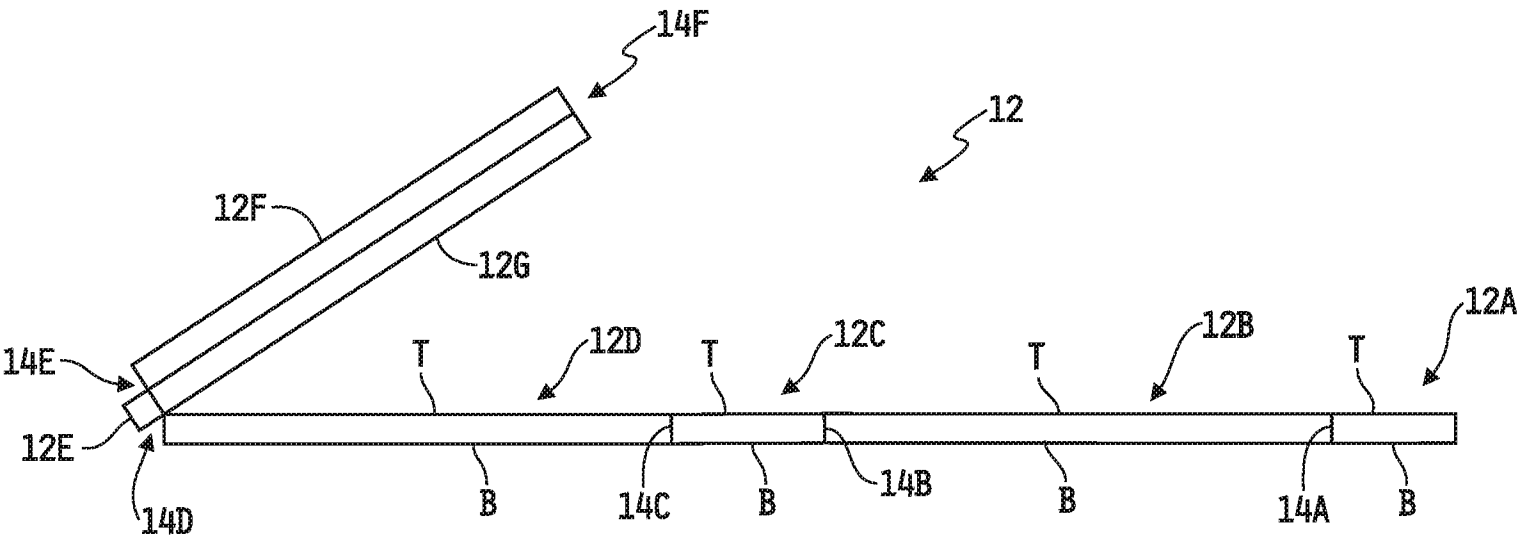
FIG. 1D is a simplified view similar to FIG. 1C showing the base panel of the torsion box panel assembly even further partially unfolded.
Figure 1E:
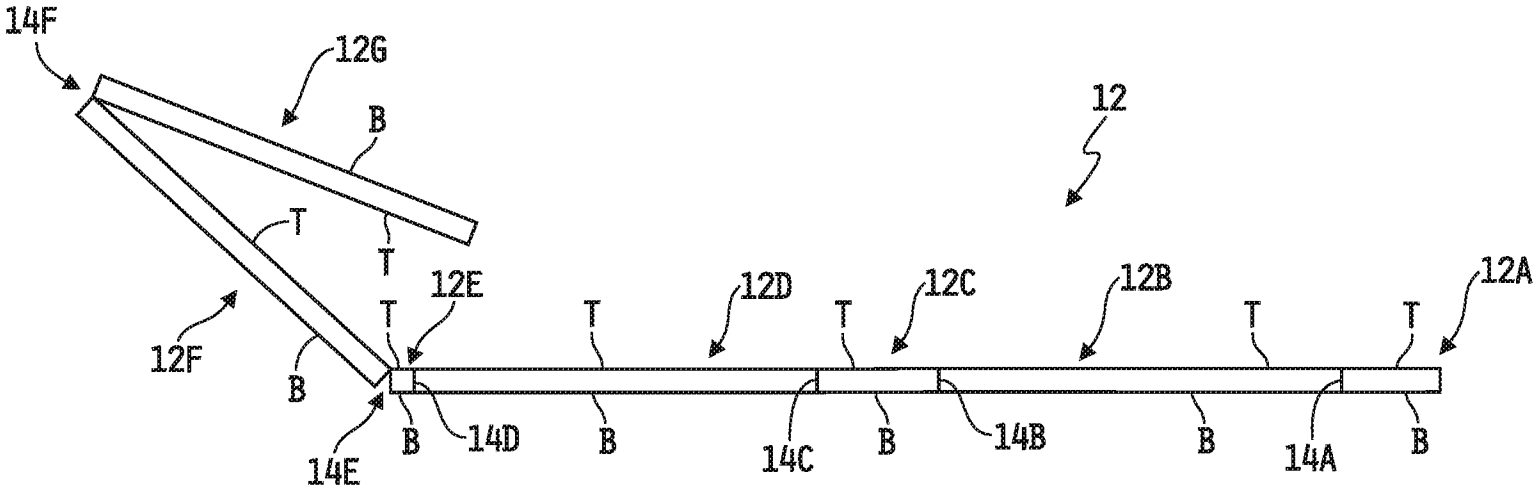
FIG. 1E is a simplified view similar to FIG. 1D showing the base panel of the torsion box panel assembly further partially unfolded.
Figure 1F:
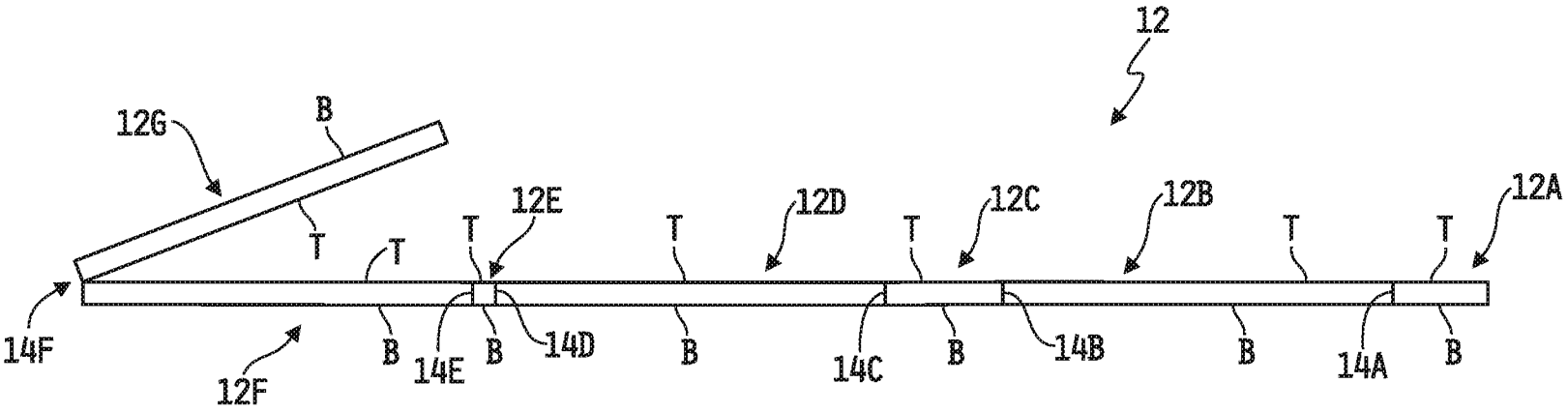
FIG. 1F is a simplified view similar to FIG. 1E showing the base panel of the torsion box panel assembly further still partially unfolded.

While the concepts of the present disclosure are susceptible to various modifications and alternative forms, specific exemplary embodiments thereof have been shown by way of example in the drawing and will herein be described in detail. It should be understood, however, that there is no intent to limit the concepts of the present disclosure to the particular forms disclosed, but on the contrary, the intention is to cover all modifications, equivalents, and alternatives consistent with the present disclosure and the appended claims.

References in the specification to "one embodiment", "an embodiment", "an example embodiment", etc., indicate that the embodiment described may include a particular feature, structure, or characteristic, but every embodiment may not necessarily include the particular feature, structure, or characteristic. Moreover, such phrases may or may not necessarily refer to the same embodiment. Further, when a particular feature, structure or characteristic is described in connection with an embodiment, it is submitted that it is within the knowledge of one skilled in the art to effect such feature, structure or characteristic in connection with other embodiments whether or not explicitly described. Further still, it is contemplated that any single feature, structure or characteristic disclosed herein may be combined with any one or more other disclosed feature, structure or characteristic, whether or not explicitly described, and that no limitations on the types and/or number of such combinations should therefore be inferred.

Referring generally to FIGS. 1A-1F, 2-3 and 6, an embodiment is shown of a torsion box panel assembly 10 which includes a base panel 12 made up of a number of sub-panels and one or more elongated stabilizing members 16. The torsion box panel assembly 10 illustratively has a compact configuration in which two or more of the sub-panels of the base panel 12 are at least partially folded relative to one another about one or more respective hinges to a compact configuration suitable for conveyance, i.e., shipping or other transport, and/or suitable for storage prior to conveyance and/or following conveyance but prior to assembly. An example of one such compact configuration of the base panel 12 is illustrated in FIG. 1A. In some embodiments, as also illustrated in FIG. 1A, the compact configuration of the base panel 12 defines a pocket 18 therein that is sized to receive and contain therein the one or more elongated stabilizing members 16 during conveyance and/or storage of the torsion box panel assembly 10. In other embodiments, the one or more elongated stabilizing members 16 may be secured to an outer portion of the folded base panel 12, and in still other embodiments the one or more stabilizing members 16 may be shipped and/or stored separately from the folded base panel 12.

In the embodiment illustrated in FIGS. 1A-1F, 2-3 and 6, the opposing major surfaces of the sub-panels of the base panel 12 are both planar, although it will be understood that in some alternate embodiments one of the major surfaces need not be planar as will be described in greater detail below. In any case, the sub-panels of the base panel 12 are shown in FIGS. 1B-1F and 2 being progressively unfolded from the example compact configuration of the base panel 12 depicted in FIG. 1A to a fully expanded configuration of the base panel 12 illustrated in FIGS. 2 and 3 in which the one or more hinges are closed so that the major planar surfaces of the sub-panels are together substantially co-planar to form the base panel 12 having a substantially planar top surface T and a substantially planar bottom surface B opposite the top surface T each made up of the combination of major planar surfaces of the sub-panels.

Thereafter, at least one stabilizing member is secured to the planar surface T of the base panel in its expanded configuration such that the secured stabilizing member(s) spans all of the closed hinges to lock the sub-panels together to form the assembled torsion box panel. In some embodiments, the stabilizing member(s) is/are secured to the top surface T of the expanded base panel 12 in a manner which maintains the base panel 12 in its expanded configuration. In some embodiments, as illustrated by example in FIG. 6, the at least one stabilizing member is provided in the form of a plurality of elongated stabilizing members 16 having lengths that extend parallel with the length of the expanded base panel 12, and are arranged relative to the expanded base panel 12 so as to span all of the one or more closed hinges such that the one or more secured stabilizing members 16 and the base panel 12 together form the torsion box panel 10. By spanning the one or more closed hinges, the one or more secured stabilizing members 16 operate, in some embodiments, to lock the one or more closed hinges in their closed positions so that the base panel 12 is correspondingly secured and locked in its expanded configuration to form the assembled torsion box panel.

As will be described in further detail below, this disclosure contemplates numerous alternative embodiments of the torsion box assembly described thus far. For example, in some alternate embodiments the stabilizing member(s) may be alternatively or additionally secured to the bottom surface B of the base panel 12. As another example, one or more of the sub-panels may, in some alternate embodiments, be separate from, i.e., not hingedly coupled to, others of the sub-panels. One particular example of this variant in which all of the sub-panels are separate from one another is illustrated in FIGS. 10A-10E. As still another example, whether or not adjacent sub-panels are hingedly coupled together, one or more braces may implemented to secure together two or more adjacent sub-panels. In some such embodiments, one or more such braces may be secured at least partially along the sides of two or more adjacent sub-panels, and in other such embodiments one or more braces may be secured to two or more of the sub-panels at either end or at both ends thereof. In non-hinged embodiments, such brace(s) is/are illustratively configured to secure together two adjacent sub-panels along their lengths or widths in a manner which locks the two sub-panels together with the planar surfaces of the sub-panels co-planar. In hinged embodiments, such braces are illustratively configured to lock the hinge(s) in a closed position to maintain the planar surfaces of the sub-panels on each side of the hinge(s) co-planar. In such hinged embodiments, the stabilizing member(s) may, but need not, be configured to perform the function of locking the hinge(s) in a closed position as the brace(s) serve this function. In any embodiments in which one or more braces are implemented, the stabilizing member(s) need not have or provide structural integrity, but rather need(s) only provide a "finished" surface opposite that which is secured to the base panel and configured to serve as the exterior "finished" surface of the assembled torsion box panel 10. In such embodiments, the stabilizing member(s) may accordingly be referred to herein as one or more "finish" panels, which may illustratively be or include one or more flexible panels, one or more semi-flexible panels and/or one or more rigid panels. In any such embodiment(s), the term "finish" or "finished" should be understood to refer to a panel or exterior surface thereof which is configured to be or be part of the exterior surface of the assembled torsion box panel 10, e.g., via selection and use of one or more conventional materials alone, via selection and use of one or more coatings, layers, films or the like applied to or otherwise covering the exposed surface of one or more conventional materials and/or via selection and use of one or more conventional techniques for preparing the exposed surface for use as the exterior surface of the assembled torsion box panel assembly 10.

Figure 2:
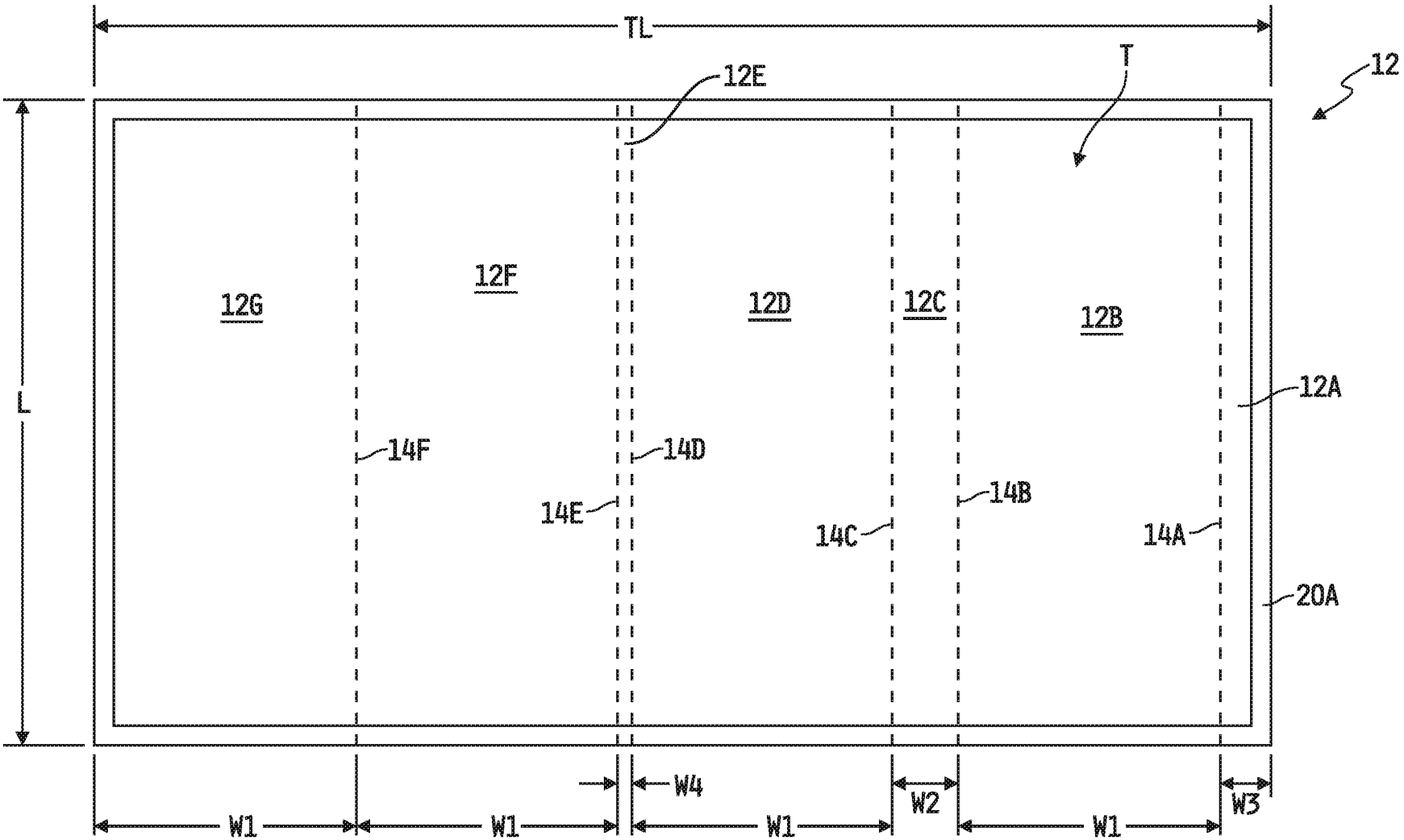
FIG. 2 is a simplified top plan view of the base panel of FIGS. 1A-1F shown further unfolded from the configuration shown in FIG. 1F to an expanded configuration.

Referring again to FIGS. 1A-1F and 2, the example base panel 12 illustratively includes seven (7) sub-panels 12A-12G hinged to one another by six (6) corresponding hinges 14A-14F. As shown in FIG. 2, the individual sub-panels 12A-12G illustratively have common lengths L. The sub-panels 12B, 12D, 12F and 12G each have widths W1, the sub-panel 12C has a width W2, the sub-panel 12A has a width W3 and the sub-panel 12E has a width W4. In its fully expanded configuration illustrated in FIG. 2, the base panel 12 thus has a total length TL equal to the sum of the widths of each of the sub-panels 12A-12G, or in the form of a mathematical expression, TL=4W1+W2+W3+W4. In any hinged or non-hinged embodiment in which gaps are provided between the adjacent sub-panels, the total length TL will further include the widths of such gaps. In any case, the base panel 12 also has a width defined by the individual lengths L of each of the aligned sub-panels 12A-12G. In the illustrated example, the lengths L are the same for each sub-panel 12A-12G, although in alternate embodiments the length(s) of one or more of the sub-panel(s) 12A-12G may be different from others of the sub-panels 12A-12G. In one specific implementation in which the sub-panels 12A-12G have common lengths Las illustrated by example in FIG. 2, which should not be considered limiting in any way, L=35 inches, W1=14.219 inches, W2=3.563 inches, W3=2.781 inches and W4=0.781 inches so that the total length, TL, and the total width, L, of the base panel 12 in its expanded configuration are 64 inches and 35 inches respectively. It will be understood that in alternate implementations, any one or more of the foregoing dimensions may be greater or lesser.

Persons skilled in the art will recognize that the embodiment of the base panel 12 illustrated in FIGS. 1A-3 represents only one hinged sub-pane example, and that alternate embodiments may include more or fewer sub-panels and/or more or fewer hinges. In other alternate embodiments, as described above, two or more of the sub-panels may not be hinged to one another at all, but may instead be provided in the form of two or more separate sub-panels. An example embodiment in which none of the sub-panels are hinged together is depicted in FIGS. 10A-10E. Moreover, it will be understood that alternate embodiments are contemplated in which the length(s) of one or more of the sub-panels may be different from the length(s) of others of the sub-panels. Further still, whereas all of the outer edges of each of the sub-panels 12A-12G are illustrated in FIGS. 1A-2 as being planar, one or more of the end-edges of one or more of the sub-panels 12A-12G and/or either or both of the non-hinged, exterior side edges of the sub-panels 12A and 12G may be non-planar (e.g., non-linear or piecewise linear) such that the exterior periphery of the panel 12 may have any desired shape. It will be further understood that, in embodiments in which at least two sub-panels are hinged together as described herein, such hinged edges need not be planar as illustrated in the attached drawings; rather, any two adjacent hinged edges may have any desired non-linear and/or piecewise linear but complementary shape which allows the two corresponding adjacent sub-panels to fold to one another along the respective hinge for shipment and/or storage, as described above, and which also allows the two corresponding sub-panels to relative to one another to a position in which the top and/or bottom planar surfaces of the two sub-panels are respectively co-planar. Further still, in embodiments in which at least two sub-panels are not hinged together, e.g., as illustrated by example in FIGS. 10A-10E, it will be understood that opposed edges of at least two sub-panels when arranged side-by-side as illustrated by example in FIG. 10E, may be planar as shown or may alternatively have any desired non-linear and/or piecewise linear but complementary shape which allows the two corresponding sub-panels to be pieced together as part of an overall desired shape of the assembled base panel 12.

In the embodiment illustrated in FIGS. 1A-3, the opposing, adjacent sides of the sub-panels 12A and 12B are foldably connected to one another by a hinge 14A which illustratively extends along the lengths L of opposing sides of each sub-panel 12A, 12B. Opposing, adjacent sides of the remaining sub-panel pairs 12B/12C, 12C/12D, 12D/12E, 12E/12F and 12F/12G are likewise foldably connected to one another by a respective hinge 14B, 14C, 14D, 14E and 14F, each of which illustratively extends along the length L of opposing sides of each sub-panel pair. In the illustrated embodiment, the hinges 14A-14F each have an opening or open end at the back or bottom B of the panel 12 such that all of the hinges 14A-14F open at the bottom or back B of the panel 12 as illustrated in FIGS. 1A-1F and 3. The hinges 14A-14F each also have a closing end or closed end, about which the respective hingedly-coupled sub-panels fold relative to one another as the hinge 14A-14F opens and closes, at the top T of the panel such that all of the hinges 14A-14F close at the top T of the panel 12 as illustrated in FIGS. 1A-2. The top surfaces T of each hinged pair of sub-panels 12A/12B, 12B/12C, 12C/12D, 12D/12E, 12E/12F and 12F/12G thus fold inwardly toward one another about a respective one of the hinges 14A-14F, and the bottom surfaces of each hinged pair of sub-panels 12A/12B, 12B/12C, 12C/12D, 12D/12E, 12E/12F and 12F/12G thus fold outwardly away from one another about a respective one of the hinges 14A-14F.

Any one of the hinges 14A-14F is considered to be closed when the planar bottom surfaces B of the respective sub-panels 12A/12B, 12B/12C, 12C/12D, 12D/12E, 12E/12F on each side of that hinge 14A-14F are substantially co-planar with one another and the planar top surfaces T of the respective sub-panels 12A/12B, 12B/12C, 12C/12D, 12D/12E, 12E/12F on each side of that hinge 14A-14F are likewise substantially co-planar with one another. Any one of the hinges 14A-14F is considered to be partially closed or partially open when the planar bottom surfaces B of the respective sub-panels 12A/12B, 12B/12C, 12C/12D, 12D/12E, 12E/12F on each side of that hinge 14A-14F are separated from one another and not substantially co-planar with one another, and the plane of the top surface T of the one of the respective sub-panels 12A/12B, 12B/12C, 12C/12D, 12D/12E, 12E/12F on one side of the hinge 14A-14F forms an angle with the plane of the top surface T of the one of the respective sub-panels 12A/12B, 12B/12C, 12C/12D, 12D/12E, 12E/12F on the opposite side of the hinge 14A-14F of less than about 180 degrees. Any one of the hinges 14A-14F is considered to be fully open when the planar bottom surfaces B of the respective sub-panels 12A/12B, 12B/12C, 12C/12D, 12D/12E, 12E/12F on each side of that hinge 14A-14F are separated from one another and not substantially co-planar with one another, and the planar top surfaces T of the respective sub-panels 12A/12B, 12B/12C, 12C/12D, 12D/12E, 12E/12F on each side of that hinge 14A-14F have been advanced toward one another either into contact with one another or, in embodiments in which the hinge 14A-14F has a bending limit, are separated from one another by a distance defined by the bending limit of the hinge 14A-14F.

In some alternate embodiments the hinges 14A-14F may be open to the top T and closed at the bottom or back B of the panel 12. In still other alternate embodiments, the hinges 14A-14F may alternatingly open to the top T and back B of the panel such that the sub-panels 12A-12G may be fan-folded, and in further alternate embodiments any one or more of the hinges 14A-14F may open to the top T or to the back B of the panel 12. In any case, the adjacent ones of the sub-panels 12A-12G are illustratively hinged to one another along their respective lengths L by respective ones of the hinges 14A-14F such that adjacent sub-panels are foldable relative to another along their lengths. In still other embodiments, the adjacent ones of the sub-panels 12A-12G may be hinged to one another along their respective widths by suitably configured respective ones of the hinges 14A-14F.

In some alternate embodiments in which two or more of the sub-panels 12A-12G are hinged to one another, one or more of the hinges may not extend entirely along the length L of the corresponding sub-panels but may instead extend only partially along any portion of the lengths L of the respective sub-panels, e.g., along only a middle section of the corresponding sub-panels. In the embodiment illustrated in FIGS. 1A-3, each of the hinges 14A-14F is provided in the form of a single hinge member. In alternate embodiments in which two or more sub-panels are hinged to one another, one or more of the hinges may be provided in the form of two or more hinges spaced apart at least partially along the lengths of the corresponding sub-panels.

Figure 3:
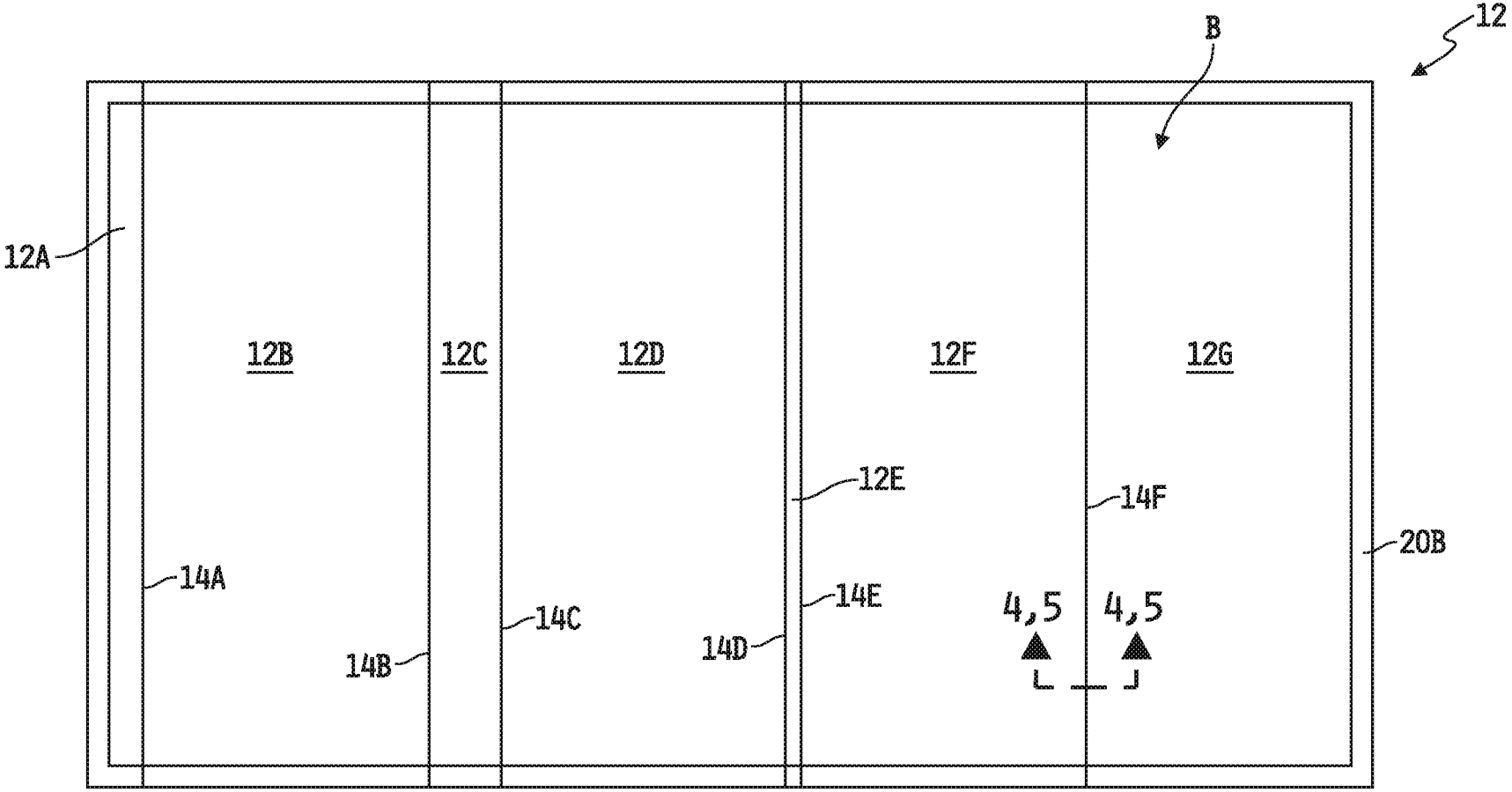
FIG. 3 is a simplified bottom plan view of the base panel of FIGS. 1A-1F shown in the expanded configuration.
Figure 4:
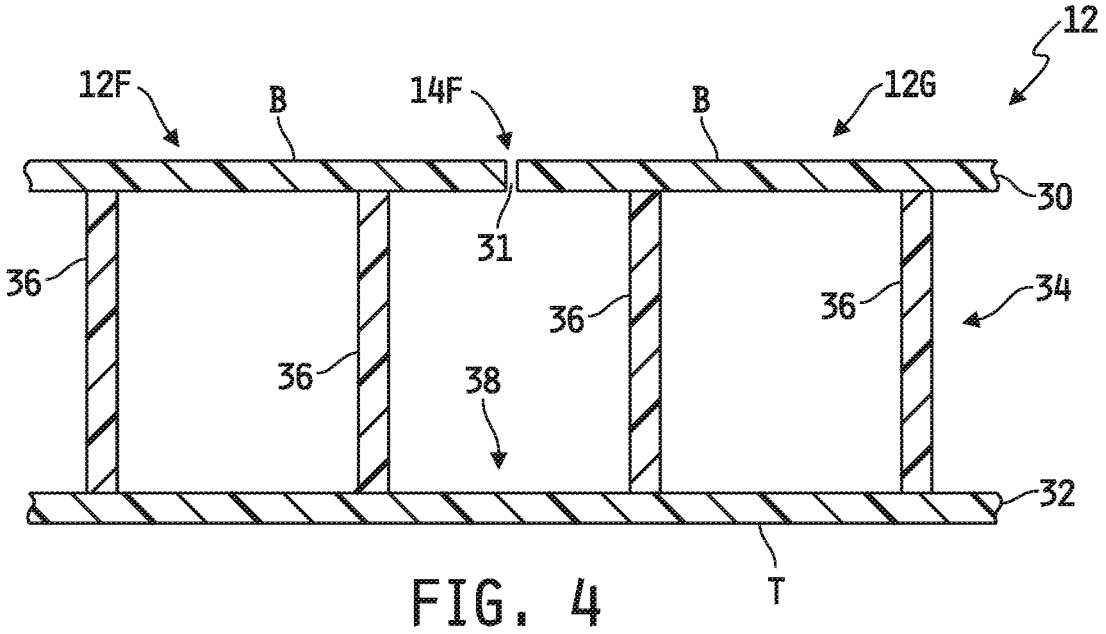
FIG. 4 is a cross-sectional view of one embodiment the base panel of FIG. 3 as viewed along sections lines 4,5-4,5.

Referring now to FIG. 4, a cross-section is shown of a portion of one embodiment the panel 12 of FIGS. 1A-3 including a portion of the sub-panel 12F, a portion of the sub-panel 12G and one embodiment of the hinge 14F coupling the sub-panels 12F, 12G together. In the embodiment illustrated in FIG. 4, the panel 12 is illustratively provided in the form of an opposed-skin panel including opposing sheets or skins 30 and 32 spaced apart by a core 34. The core 34 is illustratively made up of a plurality of ribs 36 extending between and coupled to inner surfaces of the opposed skins 30, 32. The ribs 36 are illustratively spaced apart from one another along one direction of the panel 12, e.g., along the length or width of the panel 12, and extend linearly (or non-linearly) along another direction of the panel 12, e.g., along the width or length of the panel 12. In alternate embodiments, the core 34 may form any pattern between the opposed skins 30, 32, examples of which include, but are not limited to, honeycomb, connected cylinders, connected polygons, random or pseudo-random pattern(s) or the like. In some embodiments, the opposed-skins 30, 32 and the core 34 may be of unitary construction, e.g., formed by a conventional extrusion or other known process, and in alternate embodiments the opposed-skins 30, 32 and/or the core 34 may be a laminated structure. Either or both of the opposed skins 30, 32 and/or the core 34 may illustratively be formed of or include a conventional polymer as illustrated by example in FIG. 4. Examples of such polymer may include, but are not limited to, polypropylene, high-density polyethylene, polystyrene, polyester or the like. Alternatively, either or both of the opposed skins 30, 32 and/or the core 34 may be formed of or include an organic or inorganic fiber or fibrous material, examples of which may include, but are not limited to, wood, wood composite, pulp, lignin, textile(s), or the like. In the illustrated embodiment, the exposed major surface of the skin 30 illustratively represents the planar bottom surfaces B of each of the sub-panels 12F, 12G (and illustratively of all of the sub-panels 12A-12G), and the exposed major surface of the skin 32 illustratively represents the planar top surface T of each of the sub-panels 12F, 12G (and illustratively of all of the sub-panels 12A-12G.

In the embodiment illustrated in FIG. 4, the hinge 14F is illustratively formed integrally with the panel 12, such that the sub-panels 12F, 12G and the hinge 14F are together of unitary construction. In the illustrated example, a channel 31 is formed through the skin 30 between two of the ribs 36, and the channel 31 forms the open end or opening of the hinge 14F. In some alternate embodiments, either one or both of the sides of the channel 31 may terminate co-planar with a wall of a respective rib 36. The opposed edges of the channel 31, and thus the open end of the hinge 14F, may be abutting or adjacent but non-abutting. The closed end, or back, of the hinge 14F about which the sub-panels 12F, 12G fold relative to one another as the hinge 14F opens and closes is formed by the portion 38 of the skin 32 opposite the channel 31 that extends between the two ribs 36. In the illustrated embodiment, the skin 32 is flexible, semi-flexible or otherwise bendable so as to form a closed end of a living hinge which opens and closes via the channel 31 and the portion 38 of the skin 32 opposite the channel 31 about which the sub-panels 12F, 12G fold relative to one another as the hinge 14F opens and closes.

In some alternate embodiments, one of the skins 30, 32 may be omitted in its entirety. In some embodiments, for example, the skin 30 may be omitted in which case the exposed ends of the ribs 36 left by omission of the skin 30 may be co-planar and thus define the planar bottom surfaces B of the sub-panels 12A-12G and of the base panel 12. In such embodiments which include the hinges 14A-14F, such hinges may be formed on or by the skin 32 and/or one or more of the ribs 36 or otherwise attached to either or both. In hinged or non-hinged implementations of this variant in which stabilizing member(s) or finish panel(s) are to be secured and/or to the bottom surface B of the base panel 12, such stabilizing member(s) or finish panel(s) may illustratively be secured directly to the exposed, co-planar ends of the ribs 36 making up the planar bottom surface B. In other embodiments, the skin 32 may be omitted in which case the exposed ends of the ribs 36 left by omission of the skin 32 may be co-planar and thus define the planar top surfaces T of the sub-panels 12A-12G and of the base panel 12. In such embodiments which include the hinges 14A-14F, such hinges may be formed on or by the skin 30 and/or one or more of the ribs 36 or otherwise attached to either or both. In hinged or non-hinged implementations of this variant in which stabilizing member(s) or finish panel(s) are to be secured and/or to the top surface T of the base panel 12, such stabilizing member(s) or finish panel(s) may be secured directly to the exposed, co-planar ends of the ribs 36 making up the planar top surface T.

In the embodiment illustrated in FIG. 4, the hinge 14F is considered to be closed when the edge of the skin 30 of the sub-panel 12F defining one side of the channel 31 is opposite and adjacent to (or in contact with) the edge of the skin 30 of the sub-panel 12G defining the opposite side of the channel 31 and the skin 30 of the sub-panel 12F is substantially co-planar with the skin 30 of the sub-panel 12G, and the portion 38 of the skin 32 opposite the channel 31 and between the two ribs 36 is substantially planar as illustrated by example in FIG. 4. The hinge 14F is considered to be partially open when the edge of the skin 30 of the sub-panel 12F defining one side of the channel 31 is separated from the edge of the skin 30 of the sub-panel 12G defining the opposite side of the channel 31 and the skin 30 of the sub-panel 12F is not substantially co-planar with the skin 30 of the sub-panel 12G, and the plane of the skin 32 on one side of the portion 38 forms an angle with the plane of the skin 32 on the opposite side of the portion 38 of less than about 180 degrees. The hinge 14F is considered to be fully open when the edge of the skin 30 of the sub-panel 12F defining one side of the channel 31 is separated from the edge of the skin 30 of the sub-panel 12G defining the opposite side of the channel 31 and the skin 30 of the sub-panel 12F is not substantially co-planar with the skin 30 of the sub-panel 12G, and the outer faces of the skin 32 on each side of the portion 38 have been advanced toward one another either into contact with one another or, in embodiments in which the portion 38 of the skin 32 has a bending limit, are separated from one another by a distance defined by the bending limit of the portion 38 of the skin 32. In alternate embodiments in which the skin 30 is omitted, the open end of the hinge 14F is illustratively defined by and between the ends of respective ends of the ribs 36 on each side of the portion 38 of the skin 32 defining the hinge 14F. Those skilled in the art will recognize other hinge structures, living or otherwise, that may be used in place of the hinge structure illustrated in FIG. 4, and it will be understood that any such other hinge structures are contemplated by this disclosure.

Figure 5:
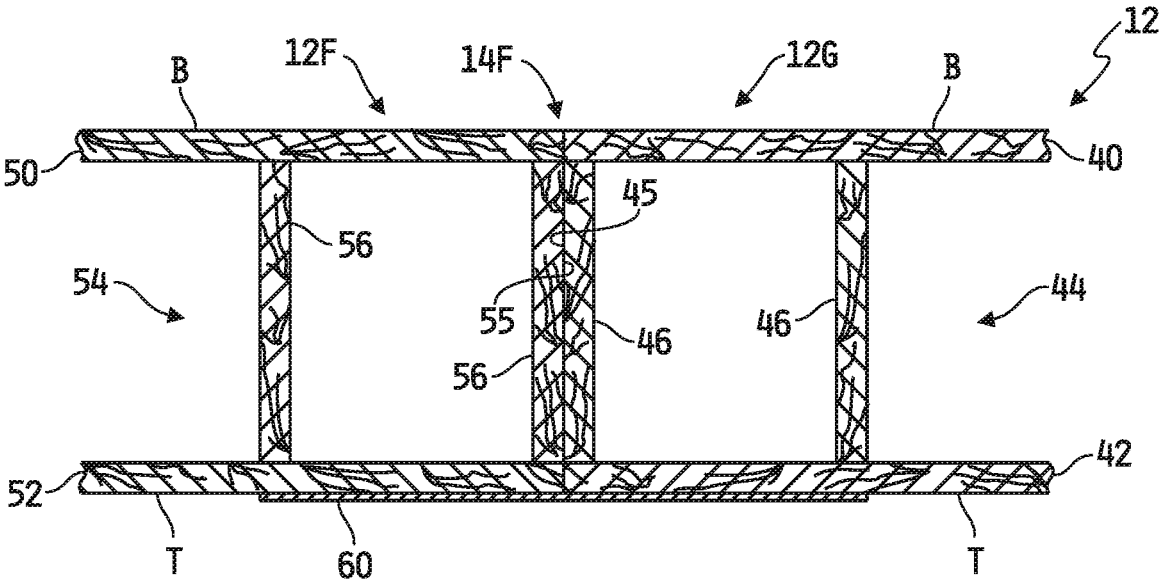
FIG. 5 is a cross-sectional view of an alternate embodiment of the base panel of FIG. 3 as viewed along section lines 4,5-4,5.
Figures 10A, 10B, 10C, 10D, 10E:
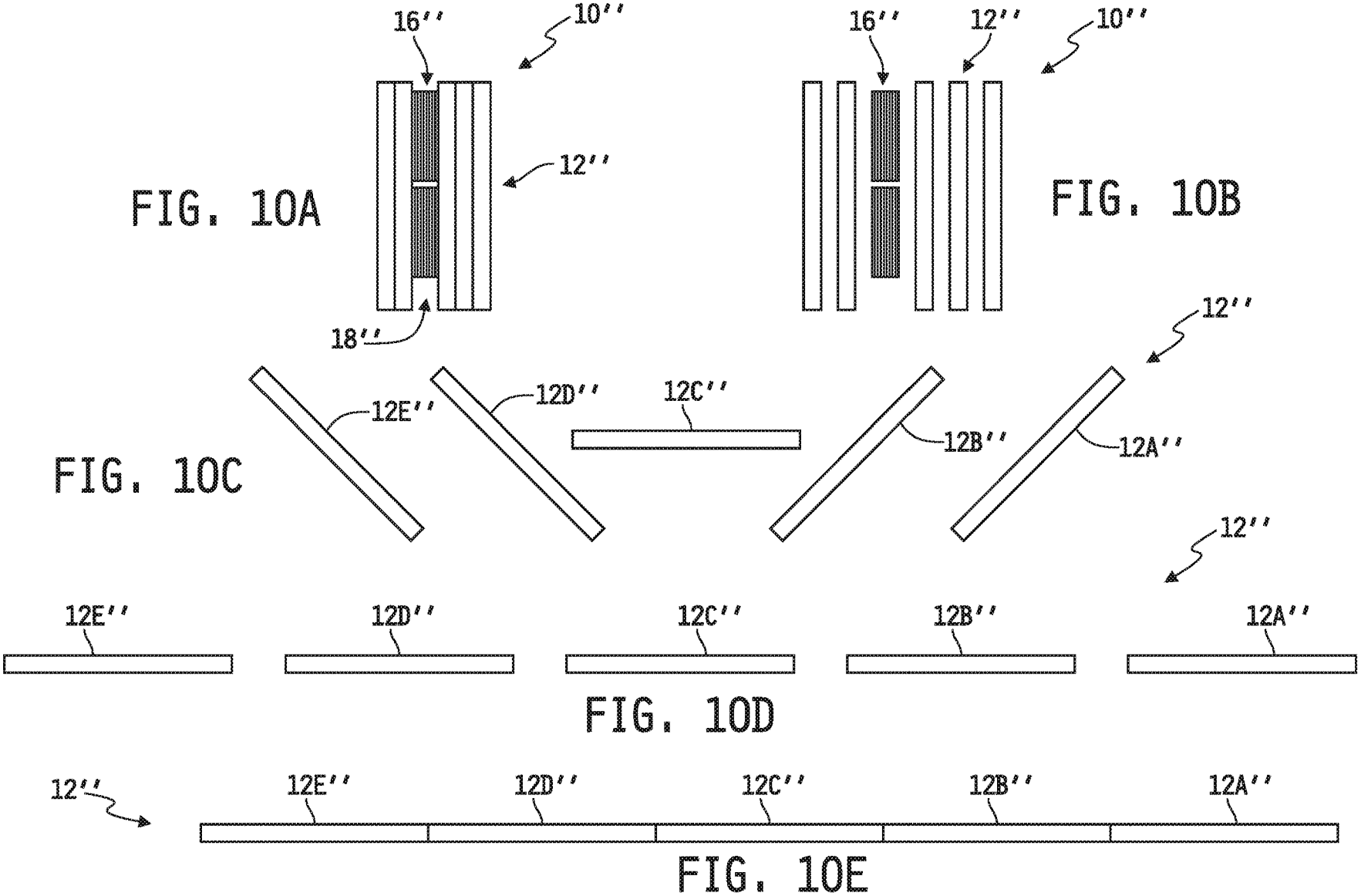
FIG. 10A is a simplified end view of yet another embodiment of a torsion box panel assembly shown in a compact configuration suitable for transport and/or storage thereof.
FIG. 10B is a simplified view similar to FIG. 10A showing the individual and separate sub-panels of the base panel of the torsion box panel assembly separated from one another.
FIG. 10C is a simplified view similar to FIG. 10B showing the individual sub-panels of the base panel further separated from one another.
FIG. 10D is a simplified view similar to FIG. 10C showing the sub-panels of the base panel in an example expanded configuration in which the sub-panels are arranged side-by-side to form non-abutting interfaces along their lengths or widths with the planar top surfaces of the sub-panels coplanar relative to one another.
FIG. 10E is a simplified view similar to FIG. 10D showing the base panel of the base panel in another example expanded configuration in which the sub-panels are arranged side-by-side to form abutting interfaces along their lengths or widths with the planar top surfaces of the sub-panels coplanar relative to one another.

Referring now to FIG. 5, a cross-section is shown of a portion of another embodiment the panel 12 of FIGS. 1A-3 including a portion of the sub-panel 12F, a portion of the sub-panel 12G and another embodiment of the hinge 14F coupling the sub-panels 12F, 12G together. In the embodiment illustrated in FIG. 5, the panel 12 is illustratively provided in the form of a number of separate, opposed-skin sub-panels 12A-12F arranged side-by-side and abutting one another to form the base panel 12, one example of which is illustrated in FIG. 10E. As depicted by example in FIG. 5, the sub-panel 12G illustratively includes opposing sheets or skins 40 and 42 spaced apart by a core 44, and the sub-panel 12F likewise illustratively includes sheets or skins 50, 52 spaced apart by a core 54. The core 44 of the sub-panel 12G is illustratively made up of a plurality of ribs 46 extending between and coupled to inner surfaces of the opposed skins 40, 42, and the core 54 of the sub-panel 12F is likewise illustratively made up of a plurality of ribs 56 extending between and coupled to inner surfaces of the opposed skins 50, 52. The ribs 46, 56 are illustratively spaced apart from one another along one direction of each sub-panel, e.g., along the length or width of each respective sub-panel 12G, 12F, and extend linearly (and/or non-linearly) along another direction of each respective sub-panel, e.g., along the width or length of each sub-panel 12G, 12F. In alternate embodiments, the core 44 and/or the core 54 may form any pattern between the opposed skins 40, 42 and/or 50, 52 respectively, examples of which include, but are not limited to, honeycomb, connected cylinders, connected polygons, random or pseudo-random pattern(s) or the like. In some embodiments, the opposed skins 40, 42 and the core 44 and/or the opposed skins 50, 52 and the core 54 of one or more of the sub-panels may be of unitary construction, e.g., formed by a conventional extrusion or other known process, and in alternate embodiments the opposed-skins 40, 42 and/or the core 44 and/or the core 44, and/or the opposed skins 50, 52 and/or the core 54, of one or more of the sub-panels may be a laminated structure. In embodiment illustrated in FIG. 5, the opposed skins 40, 42, the core 44, the opposed skins 50, 52 and the core 54 are all formed of or include a conventional organic or inorganic fiber or fibrous material, examples of which may include, but are not limited to, wood, wood composite, pulp, lignin, textile(s), or the like. Alternatively, the opposed skins 40, 42 and/or the core 44, and/or the opposed skins 50, 52 and/or the core 54, may illustratively be formed of or include a conventional polymer, examples of which include, but are not limited to, polypropylene, high-density polyethylene, polystyrene, polyester or the like. In some alternate embodiments, one of the skins 40, 42 of one or more of the sub-panels may be omitted and/or one of the skins 50, 52 of one or more of the sub-panels may be omitted. In the illustrated embodiment, the exposed major surfaces of the skins 50 and 40 illustratively represent the planar bottom surfaces B of the respective sub-panels 12F, 12G, and the exposed major surfaces of the skins 52, 42 illustratively represent the planar top surfaces T of the respective sub-panels 12F, 12G.

In the embodiment illustrated in FIG. 5, the sub-panels 12F, 12G are separate from one another and the opposed, abutting side edges of the sub-panels 12F, 12G are illustratively formed by the outer surface 55 of the outermost rib 56, the corresponding exposed edge of the skin 50 and the corresponding exposed edge of the skin 52 of the sub-panel 12F, all of which are illustratively co-planar with one another, and the outer surface 45 of the outermost rib 46, the corresponding exposed edge of the skin 40 and the corresponding exposed edge of the skin 42 of the sub-panel 12G, all of which are likewise illustratively co-planar with one another. Alternatively, either or both of the exposed edges of the skins 50, 52 may extend beyond the outer surface 55 of the outermost rib 56 of the sub-panel 12F such that the corresponding side of the sub-panel 12F is "open," i.e., the outer surface 55 of the outermost rib 56 is recessed relative to one or both of the exposed edges of the skins 50, 52, and/or one or both of the exposed edges of the skins 40, 42 may extend beyond the outer surface 45 of the outermost rib 46 of the sub-panel 12G such that the corresponding side of the sub-panel 12G is "open," i.e., the outer surface 45 of the outermost rib 46 is recessed relative to one or both of the exposed edges of the skins 40, 42. In such embodiments, either or both of the opposed side edges of the sub-panels 12F, 12G may be left open or may be capped by suitable edge trim. In any case, the hinge 14F in the embodiment illustrated in FIG. 5 is illustratively formed at the interface of the abutting sides of the sub-panels 12F, 12G, i.e., along the abutting side edges of the sub-panels 12F, 12G. In alternate embodiments in which the sub-panels 12F, 12G are separate from one another and arranged side-by-side in a non-abutting relationship relative to one another, the hinge 14F is likewise formed at the interface of the sub-panels 12F, 12G although in this embodiment the gap between the non-abutting sides of the sub-panels 12F, 12G forms part of the hinge 14F.

In the embodiment illustrated in FIG. 5, the open end of the hinge 14F is illustratively defined at and by the interface between the abutting, exposed edges of the skins 50, 40 of the respective sub-panels 12F, 12G. In alternate embodiments in which a gap exists between the sides of the sub-panels 12F, 12G as described above, the open end of the hinge 14F is defined by the spaced apart exposed edges of the skins 50, 40 of the respective sub-panels 12F, 12G. The closed end of the hinge 14F is illustratively formed along the opposed sides of the sub-panels 12F, 12G by a flexible or semi-flexible sheet 60 affixed to, and thus foldably connecting, the opposed sides of the sub-panels 12F, 12G. In the example embodiment depicted in FIG. 5, the sheet 60 illustratively spans the interface between the abutting sides of the sub-panels 12F, 12G and is affixed to portions of the exposed major surfaces of the skins 52, 42 of the respective sub-panels 12F, 12G on either side of the interface. In such embodiments, the flexible sheet 60 may overlap the interface by any desired amount which may or may not depend upon the material used for the sheet 60 and/or the material composition of either of both of the skins 42, 52. In some alternate embodiments, the sheet 60 may alternatively or additionally be affixed on the side of the sub-panel 12F to the exposed edge of the skin 52, to the exposed side of the rib 56 and/or to any side capping trim in embodiments which may include such a capping trim. Likewise, the sheet 60 may alternatively or additionally be affixed on the side of the sub-panel 12G to the exposed edge of the skin 42, to the exposed side of the rib 46 and/or to any side capping trim in embodiments which may include such a capping trim.

In one embodiment, the flexible sheet 60 is illustratively an adhesive-backed tape, although in alternate embodiments the flexible sheet 60 may be or include any suitable flexible, semi-flexible or otherwise bendable material secured to the two sub-panels 12F, 2G by one or more bonding media, one or more adhesives, one or more mechanical fasteners and/or by one or more suitable welding techniques. The sheet 60 may extend the length of the two sub-panels 12F, 12G or may extend only partially along the length, e.g., along a middle section of each sub-panel 12F, 12G. Alternatively still, two or more sheets 60 may be spaced apart along the lengths of the sub-panels 12F, 12G. In any case, the sheet 60 forms the closed end, or back, of the hinge 14F about which the sub-panels 12F, 12G fold relative to one another as the hinge 14F opens and closes.

In some alternate embodiments, one of the sets of skins 40, 50 or 42, 52 may be omitted in its entirety. In some such embodiments, for example, the skins 40, 50 may be omitted in which case the exposed ends of the ribs 46, 56 left by omission of the skins 40, 50 may be co-planar and thus define the planar bottom surfaces B of the sub-panels 12A-12G. In such embodiments which include the hinges 14A-14F, such hinges may be secured to either or both of the skins 42, 52 and/or to either or both of the ribs 46, 56 at least partially defining the respective hinges. In hinged or non-hinged implementations of this variant in which stabilizing member(s) or finish panel(s) are to be secured and/or to the bottom surface B of the base panel 12, such stabilizing member(s) or finish panel(s) may illustratively be secured directly to the exposed, co-planar ends of the ribs 46, 56 making up the planar bottom surface B. In other embodiments, the skins 42, 52 may be omitted in which case the exposed ends of the ribs 46, 56 left by omission of the skins 42, 52 may be co-planar and thus define the planar top surfaces T of the sub-panels 12A-12G. In such embodiments which include the hinges 14A-14F, such hinges may be secured to either or both of the skins 40, 50 and/or to either or both of the ribs 46, 56 at least partially defining the respective hinges. In hinged or non-hinged implementations of this variant in which stabilizing member(s) or finish panel(s) are to be secured and/or to the top surface T of the base panel 12, such stabilizing member(s) or finish panel(s) may be secured directly to the exposed, co-planar ends of the ribs 46, 56 making up the planar top surface T.

In the embodiment illustrated in FIG. 5 with the flexible sheet 60 attached as shown, the hinge 14F is considered to be closed when the skin 50 of the sub-panel 12F is substantially co-planar with the skin 40 of the sub-panel 12G, and the skin 52 of the sub-panel 12F is likewise substantially co-planar with the skin 42 of the sub-panel 12G as illustrated by example in FIG. 5. The hinge 14F of FIG. 5 is considered to be partially open when the edge of the skin 50 of the sub-panel 12F that is co-planar with the outer surface 55 of the outermost rib 56 is separated from the edge of the skin 40 of the sub-panel 12G that is co-planar with the outer surface 45 of the outermost rib 46 and the skin 50 of the sub-panel 12F is not substantially coplanar with the skin 40 of the sub-panel 12G, and the plane of the skin 52 of the sub-panel 12F forms an angle with the plane of the skin 42 of the sub-panel 12G of less than about 180 degrees. The hinge 14F of FIG. 5 is considered to be fully open when the edge of the skin 50 of the sub-panel 12F that is co-planar with the outer surface 55 of the outermost rib 56 is separated from the edge of the skin 40 of the sub-panel 12G that is co-planar with the outer surface 45 of the outermost rib 46 and the skin 50 of the sub-panel 12F is not substantially coplanar with the skin 40 of the sub-panel 12G, and the outer faces of the skins 52, 42 on each side of the interface between the outer surfaces 55, 45 of the outermost ribs 56, 46 respectively have been advanced toward one another either into contact with one another or, in embodiments in which the flexible sheet 60 has a bending limit, are separated from one another by a distance defined by the bending limit of the flexible sheet 60. In alternate embodiments in which the skins 40, 50 are omitted, the open end of the hinge 14F is illustratively defined by and between the ends of respective ends of the ribs 56, 46 on each side of the interface between the respective panels 12F, 12G. Those skilled in the art will recognize other hinge structures, living or otherwise, that may be used in place of the hinge structure illustrated in FIG. 5, and it will be understood that any such other hinge structures are contemplated by this disclosure.

Referring again specifically to FIGS. 1A-1F, one compact configuration of the base panel 12 is shown in which all of the hinges 14A-14F are open. In alternate embodiments, it will be understood that a compact configuration of the base panel 12 may include fewer open or partially open hinges 14A-14F. In the extreme, a compact configuration of the base panel 12 may be defined by at least one of the hinges 14A-14F being at least partially open. In the example illustrated in FIGS. 1A-1F, the widths of the sub-panels 12A-12F are illustratively selected such that all of the sub-panels 12A-12G fold relative to each other about the respective hinges 14A-14F into a compact configuration in which a pocket 18 is formed. In the illustrated embodiment, the pocket 18 is bordered by the top surfaces T of the sub-panels 12A, 12B and 12C and by the bottom surface B of the sub-panel 12F. Illustratively, the pocket 18 is sized, in embodiments in which the compact configuration of the base panel 12 defines such a pocket 18, to receive and contain therein the one or more stabilizing members 16 such that the one or more stabilizing members 16 are carried within the pocket 18. In this resulting compact configuration of the entire torsion box assembly 10, shipping and/or storage space, and associated costs, are thus reduced as compared with conventional assemblies. As illustrated in FIGS. 1A-1F, the sub-panels 12A-12G are sequentially unfolded to form the planar base panel 12 in its fully extended configuration as illustrated in FIGS. 2 and 3. In one embodiment, one or more sheets or films 20A, 20B may be affixed to the base panel 12 at least partially about its top and/or back peripheries. In the example illustrated in FIGS. 2 and 3 respectively, sheets or films 20A, 20B are secured to the top and bottom surfaces T, B respectively adjacent to and about the periphery of the base panel 12. Alternatively, only one such sheet or film 20A, 20B may be affixed to the base panel 12. In some embodiments, the sheet(s) or film(s) 20A, 20B may be provided only for protection of the panel edge(s) during conveyance and/or storage, and may thus be configured to be removed prior to securing the one or more stabilizing members 16 thereto. In other embodiments, either or both of the sheets or films 20A, 20B may be configured or intended to remain affixed or otherwise secured to the panel 12 through completion of the assembly. In still other embodiments, either or both of the sheets or films 20A, 20B may be provided in the form of one or more structural sheets, strips or plates, e.g., rigid or semi-rigid, configured to impart stiffness and/or strength to the base panel 12 so as to maintain the planar shape of the base panel 12 in its extended configuration. Such a feature may illustratively be advantageous when the base panel 12 is placed on an uneven or non-uniform surface prior to affixing the one or more stabilizing members 16 thereto, and/or if the base panel 12 is to be mounted in place, e.g., as part of a larger structure, prior to affixing the one or more stabilizing members 16 thereto. In any case, such structural sheet(s) or film(s) 20A and/or 20B is/are configured or intended to remain affixed or otherwise secured to the panel 12 through completion of the assembly 10. In still other embodiments, both sheets or films 20A, 20B may be omitted.

Figure 6:
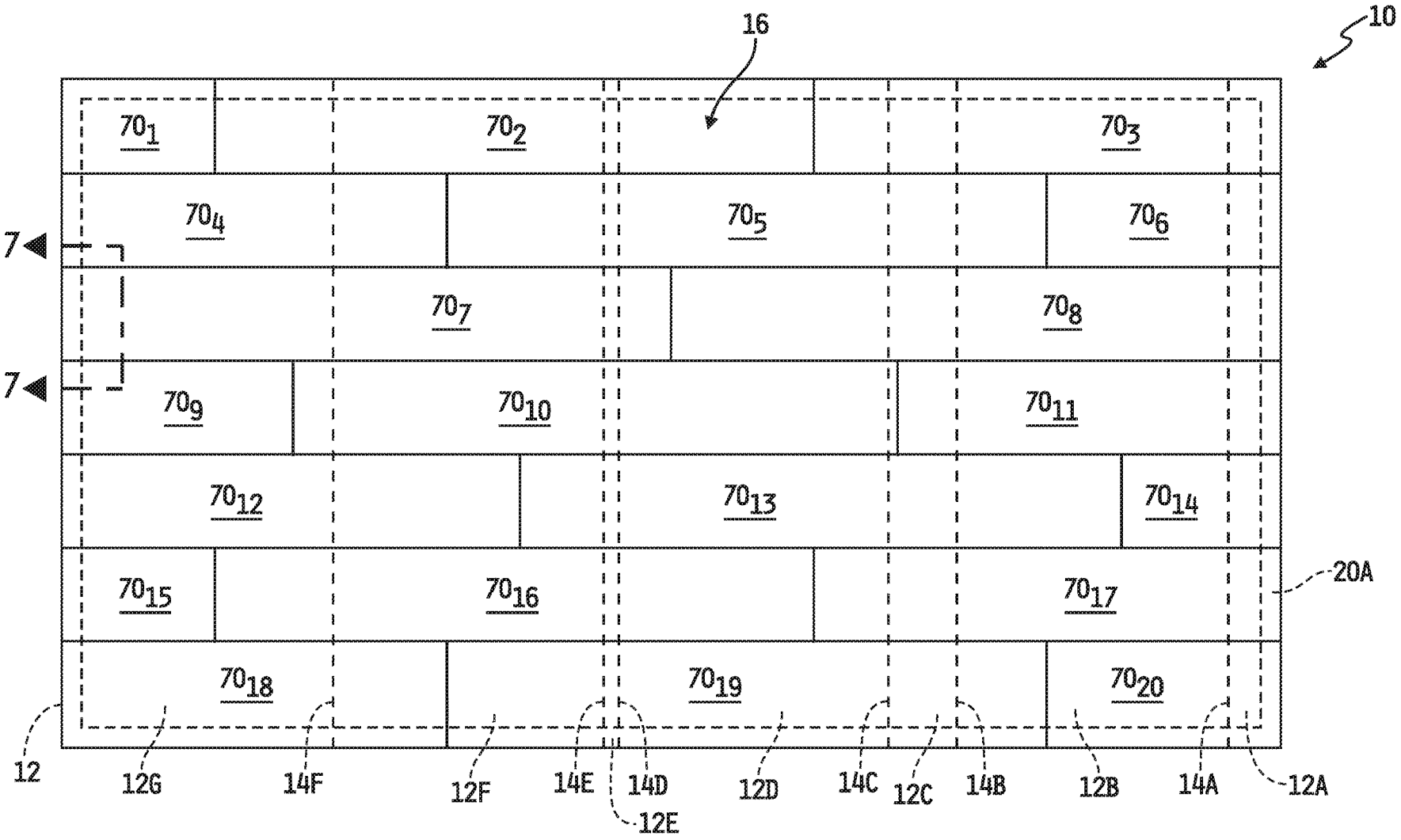
FIG. 6 is a simplified top plan view of the torsion box panel assembly of FIGS. 1A-1B shown fully assembled with the stabilizing members secured to the top surface of the base panel of FIGS. 2 and 3 in a manner that locks the hinges of the base panel in their closed positions.

Referring now to FIG. 6, the assembly 10 is completed by securing the one or more elongated stabilizing members 16 to the top surface T of the base panel 12 in its fully expanded configuration. In some alternate embodiments, the stabilizing member(s) 16 may instead be secured to the back surface B of the base panel 12 in its fully expanded configuration. In still other alternate embodiments, the stabilizing member(s) 16 may be secured to both the top surface T and the bottom surface B. In any case, the one or more elongated stabilizing members 16 illustratively has/have length(s) which is/are, in the illustrated embodiment, oriented to extend in a direction that is parallel with the total length TL of the base panel 12 (i.e., perpendicular to the directions of the hinges 14A-14F), and which is/are sized to span all of the one or more closed hinges when arranged on the top and/or back surface of the base panel 12 so that the one or more secured stabilizing members 16 and the base panel 12 together form an assembled torsion box panel 10. In alternate embodiments, the one or more elongated stabilizing members 16 may be configured or oriented to extend in one or more directions that is/are not parallel with the total length TL, of the base panel 12. As one example, which should not be considered limiting in any way, the one or more elongated stabilizing members 16 may include multiple elongated stabilizing members, at least some of which are configured to extend diagonally across at least a portion of the top and/or back surface of the base panel 12.

In the embodiment illustrated in FIG. 6, the one or more stabilizing members 16 illustratively include a plurality of elongated stabilizing members 16. In embodiments in which the base panel 12 forms a pocket 18 in its compact configuration, the one or more stabilizing members 16 are illustratively disposed in the pocket 18 such that the one or more stabilizing members is/are carried by the base panel 12 within the pocket 18 in its compact form. In some alternate embodiments, the one or more stabilizing members 16 may be provided in the form of a single, e.g., flexible or semi-flexible, stabilizing member 16. In embodiments in which the base panel 12 forms a pocket 18 in its compact form, the single stabilizing member may be foldable or rollable to fit within the pocket 18 of the base panel 12 in its compact configuration illustrated in FIG. 1A. In any case, by spanning the one or more closed hinges, e.g., 14A-14F, the one or more secured stabilizing members 16 operate to lock the one or more closed hinges, e.g., 14A-14F, in their closed positions so that the base panel 12 is correspondingly secured and locked in its expanded, planar configuration to form the torsion box panel assembly 10.

In one embodiment, the one or more stabilizing members 16 may be provided in the form of one or more panels or planks configured to be secured to the top and/or bottom surface of the base panel 12. In some alternate embodiments, the one or more stabilizing members 16 may have any desired shape or profile. In any case, the one or more stabilizing members 16 may be formed of any one or combination of organic and/or inorganic materials without limitation. The one or more stabilizing members 16 may illustratively be secured to the top and/or bottom surface of the base panel 12 by one or more conventional bonding media, one or more conventional adhesives and/or one or more conventional mechanical fasteners. In some embodiments, the top, exposed surfaces of the one or more stabilizing members 16 are planar, although in other embodiments the top, exposed surfaces of at least one of the one or more stabilizing members 16 may be non-planar and/or piecewise planar.

In embodiments in which the one or more stabilizing members 16 include a plurality of elongated stabilizing members, such stabilizing members 16 may illustratively have differing lengths configured to be arranged in multiple rows of two or more members 16 positioned end-to-end. Illustratively, the differing lengths of the various stabilizing members 16 are selected such that each row spans the length TL of the base panel 12 and such that the multiple rows completely cover the top surface T of the base panel 12. In some embodiments, as illustrated by example in FIG. 6, the differing lengths of the various stabilizing members 16 are selected such that each stabilizing member 16 in each row spans one or more of the hinges 14A-14F, i.e., so that none of the abutting ends in any of the rows of end-to-end stabilizing members 16 are positioned over any of the hinges 14A-14F. In other embodiments, the sizes of the various stabilizing members 16 may be selected such that abutting ends of two or more stabilizing members may be positioned over one or more hinges 14A-14F. In either case, the differing lengths may be selected in some embodiments so as to stagger the abutting ends between adjacent rows. In some embodiments in which the base panel 12 in its compact configuration forms a pocket 18, the differing lengths of the multiple elongated stabilizing members 16 may be selected so as to be stacked together in one or more stacks each sized and configured to fit within the dimensions of the pocket 18 of the base panel 12, as illustrated by example in each of FIGS. 1A, 9A and 10A.

In the specific example illustrated in FIG. 6, the one or more elongated stabilizing members 16 includes 20 elongated stabilizing members $\mathbf{70}_1$-$\mathbf{70}_{20}$ configured to be arranged on the top and/or bottom surface of the base panel 12 as shown. Illustratively, the elongated stabilizing members $\mathbf{70}_1$-$\mathbf{70}_{20}$ are sized such that, when arranged end-to-end in multiple rows as shown, each elongated stabilizing member $\mathbf{70}_1$-$\mathbf{70}_{20}$ spans one or more of the hinges 14A-14F, none of the abutted ends of adjacent (end-to-end) stabilizing members aligns with any hinge 14A-14F and none of the abutted ends align with abutted ends in any adjacent row. Using the example numerical dimension described above, one example sizing of the elongated stabilizing members $\mathbf{70}_1$-$\mathbf{70}_{20}$ is, consecutively, 8, 32, 24, 20, 32, 12, 32, 32, 12, 32, 20, 24, 32, 8, 8, 32, 24, 20, 32 and 12 inches respectively. Such sizing illustratively achieves the foregoing goals, and further allows for stacking of the elongated stabilizing members $\mathbf{70}_1$-$\mathbf{70}_{20}$ in combinations which, for each layer of the stack, results in a length of approximately 32 inches (e.g., 12 and 20, 24 and 8) so that the stacked elongated stabilizing members $\mathbf{70}_1$-$\mathbf{70}_{20}$ fit neatly within the 14.219 inch×35 inch pocket 18. In some embodiments, lines or other indicia may be printed or otherwise provided on the surface T of the base panel 12 which outline one or more areas of the top surface T to which one or more correspondingly sized elongated stabilizing members $\mathbf{70}_1$-$\mathbf{70}_{20}$ is/are to be placed and affixed to thereby provide a visual guide to locating and applying one or more of the stabilizing members $\mathbf{70}_1$-$\mathbf{70}_{20}$ in. Alternatively or additionally, numbers, codes or other identifying indicia may be printed or otherwise provided on and along the top surface T of the base panel 12, e.g., within the various printed areas or borders in embodiments which include them, and corresponding numbers, codes or other identifying indicia may be printed or otherwise provided on the contacting surface, i.e., the underside, of the stabilizing members $\mathbf{70}_1$-$\mathbf{70}_{20}$, wherein the numbers, codes or other indicia provided on the base panel match and identify the locations where correspondingly numbered, coded or otherwise indicated ones of the stabilizing members $\mathbf{70}_1$-$\mathbf{70}_{20}$ are to be located and affixed.

Figure 7:
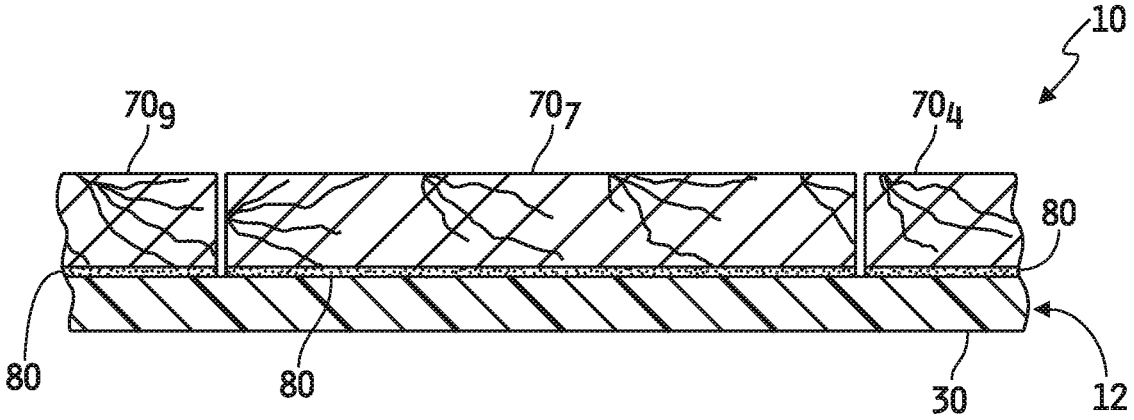
FIG. 7 is a cross-sectional view of a portion of the assembled torsion box panel of FIG. 6 as viewed along section lines 7-7.
Figure 8:
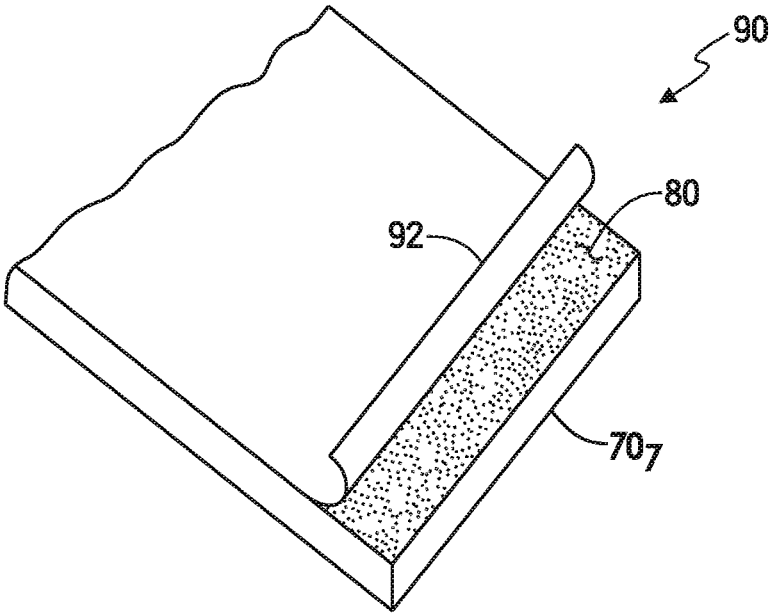
FIG. 8 is a simplified bottom perspective view of an embodiment of one of the stabilizing members shown with an adhesive layer disposed on one side and a removable sheet or film partially disposed over the adhesive layer.

In one specific example embodiment, the elongated stabilizing members $\mathbf{70}_1$-$\mathbf{70}_{20}$ are illustratively provided in the form of wood veneer panels. Referring to FIG. 7, a cross-section is shown of such an embodiment as viewed along section lines 7-7 of FIG. 6. In the illustrated embodiment, the veneers $\mathbf{70}_7$, $\mathbf{70}_8$ and $\mathbf{70}_9$ are shown secured by an adhesive layer 80 to the top skin 32 of the embodiment of the base panel 12 illustrated by example in FIG. 4. In the illustrated example, gaps are provided between the sides of the veneers $\mathbf{70}_7$, $\mathbf{70}_8$ and $\mathbf{70}_9$ to allow for humidity or other moisture-based expansion and contraction of the veneers. In some alternate embodiments, two or more of the veneers $\mathbf{70}_1$-$\mathbf{70}_{20}$ may instead abut one another. In FIG. 8, an example embodiment 90 is shown of one of the veneers $\mathbf{70}_7$ having the adhesive layer 80 pre-applied to one face thereof and a removable adhesive protection sheet 92 temporarily affixed to the adhesive layer 80. In this embodiment, the veneer $\mathbf{70}_7$ is secured to the base panel 12 by removing the protection sheet 92 and then pressing the veneer $\mathbf{70}_7$ onto the surface of the base panel 12 such that the adhesive layer 80 adheres to both the veneer $\mathbf{70}_7$ and to the surface of the base panel 12. In some alternative embodiments, the adhesive layer 80 may not cover the entire under-surface of the veneer $\mathbf{70}_7$ but may instead be applied in any desirable pattern covering less than the entire under-surface. In other alternative embodiments, the adhesive layer 80 may not be pre-applied to one or more of the veneers $\mathbf{70}_1$-$\mathbf{70}_{20}$, but may be applied separately to the one or more veneers $\mathbf{70}_1$-$\mathbf{70}_{20}$ and/or to the surface of the base panel 12. In still other embodiments, the adhesive layer 80 may be replaced and/or supplemented with either or a combination of a bonding medium or one or more mechanical fasteners. In any case, the medium and/or mechanism used to secure the veneers $70_1$-$70_{20}$ to the top or bottom surface of the base panel 12 operate(s) to secure the veneers $70_1$-$70_{20}$ to the base panel 12 sufficiently to lock the hinges 14A-14F in their closed positions so that the base panel 12 is correspondingly secured and locked in its expanded configuration to form the torsion box panel.

It will be understood that the wood veneers $70_1$-$70_{20}$ illustrated in FIGS. 6-8 and described above represent only one example implementation of the one or more elongated stabilizing member(s) 16, and that this disclosure contemplates one or any combination of alternately configured elongated stabilizing member(s) 16. Such one or more elongated stabilizing member(s) 16 may, in some embodiments, be strictly structural in nature and in such embodiments additional decorative or other layers may be applied on top of such one or more elongated stabilizing member(s) 16. In other embodiments, such as illustrated in FIGS. 6-8, the one or more elongated stabilizing member(s) 16 may be both structural and decorative such that no additional layers need to be applied on top of the one or more stabilizing members 16. In either case, it will be understood that this disclosure contemplates embodiments in which the one or more elongated stabilizing member(s) 16 is/are secured to only the top surface T, i.e., to the exposed surface of the top skin, of the base panel 12 as illustrated by example in FIG. 6, alternate embodiments in which one or more elongated stabilizing member(s) 16 is/are secured only to the bottom surface B, i.e., to the exposed surface of the bottom skin, of the base panel 12, and still other alternate embodiments in which one or more elongated stabilizing member(s) 16 is/are secured to both of the top and bottom surfaces T and B respectively of the base panel 12. In still further embodiments, the one or more elongated stabilizing member(s) 16 may be applied not to an outer surface of a skin of the base panel 12 but rather directly to the top and/or bottom surface of the core of the base panel (e.g., in embodiments in which the base panel 12 includes only one skin as described above). It will be further understood that in any embodiment in which multiple elongated stabilizing members 16 are used, at least one of the elongated stabilizing members 16 may be dimensionally and/or materially different from one or more others of the elongated stabilizing members 16.

Figure 9A:
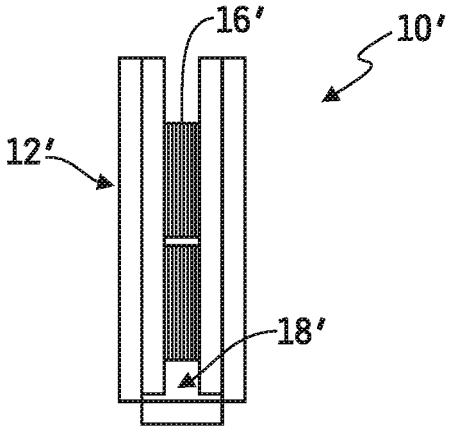
FIG. 9A is a simplified end view of another embodiment of a torsion box panel assembly shown in a compact configuration suitable for transport and/or storage thereof.
Figure 9B:
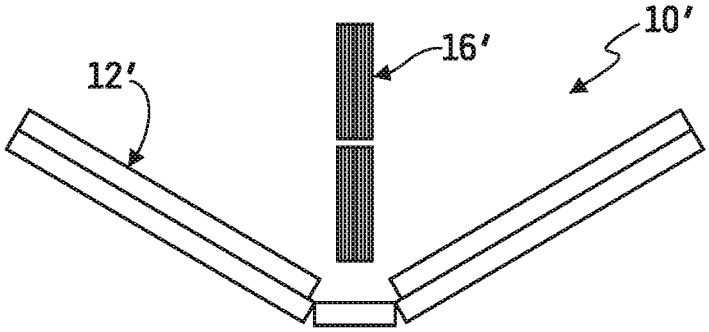
FIG. 9B is a simplified view similar to FIG. 9A showing the base panel of the torsion box panel assembly partially unfolded.
Figure 9C:
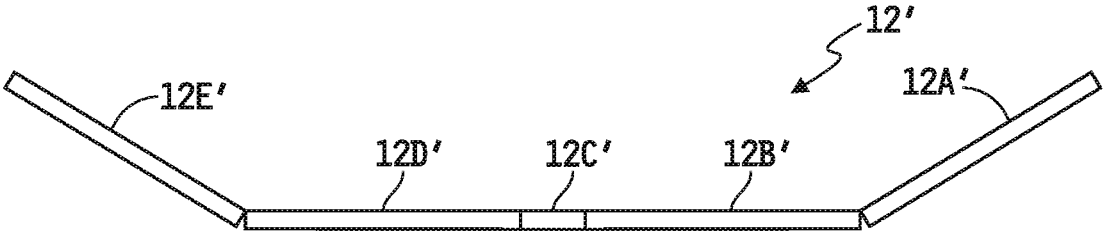
FIG. 9C is a simplified view similar to FIG. 9B showing the base panel of the torsion box panel assembly further partially unfolded.
Figure 9D:
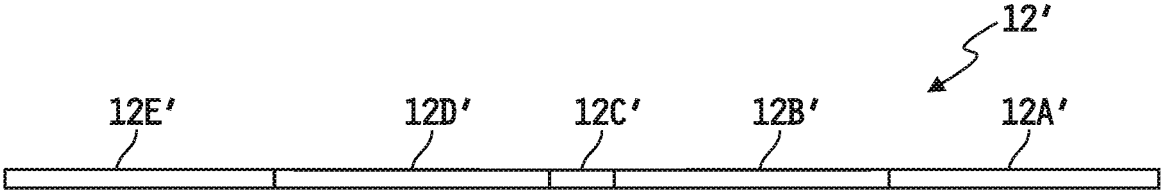
FIG. 9D is a simplified view similar to FIG. 9C showing the base panel fully unfolded to an expanded configuration.

Referring now to FIGS. 9A-9D, an alternate embodiment of a torsion box panel assembly 10' is shown including an alternate base panel 12' and one or more elongated stabilizing members 16'. The assembly 10' identical in many respects to the assembly 10 illustrated in FIGS. 1A-8, and described above, and in such respects the above description applies equally to the assembly 10'. The assembly 10' differs from the assembly 10 in the configuration of the base panel 12'. As illustrated in FIG. 9A, the compact configuration of the base panel 12' forms an open-ended pocket 18' sized to receive the one or more elongated stabilizing members 16' therein. The configuration of the base panel 12' further differs from the base panel 12 in the number of sub-panels, 12A'-12E' and also in the locations of, and spacing between, the corresponding hinges. Consequently, the one or more elongated stabilizing members 16' likewise differ(s) from the one or more elongated stabilizing members 16 in that the one or more elongated stabilizing members 16' is/are sized and configured to completely cover the top (or bottom) surface of the base panel 12' in its expanded configuration in the same manner described above with respect to FIG. 6.

Referring now to FIGS. 10A-10E, another alternate embodiment of a torsion box panel assembly 10" is shown including an alternate base panel 12" and one or more elongated stabilizing members 16". The assembly 10" identical in some respects to the assembly 10 illustrated in FIGS. 1A-8, and described above, and in such respects the above description applies equally to the assembly 10". The assembly 10" differs from the assembly 10 in the configuration of the base panel 12'. For example, the sub-panels 12A"-12E" are not hinged to one another but are instead separate components. In its compact configuration, the base panel 12" thus comprises a collection of individual sub-panels stacked together with the one or more elongated stabilizing members 16 positioned in an open pocket 18" between two such sub-panels as illustrated by example in FIG. 10A. The configuration of the base panel 12" further differs from the base panel 12 in the number of sub-panels, 12A"-12E". As illustrated in FIGS. 10C-10E, the individual sub-panels 12A"-12E" are arranged side-by-side to form an expanded base panel assembly 12", and the one or more elongated stabilizing members 16" is/are then secured to the expanded base panel assembly 12" to secure together the individual sub-panels 12A"-12E". In one embodiment, the individual sub-panels 12A"-12E" are arranged side-by-side in abutting relationship with each other form the expanded base panel assembly 12", and in other embodiments at least to adjacent ones of the individual sub-panels 12A"-12E" are spaced apart at least partially along their lengths. In some embodiments, two or more sub-panels may be hinged together as described above, and in other embodiments no sub-panel is hinged to any other sub-panel. In any case, the one or more elongated stabilizing members 16" likewise differ(s) from the one or more elongated stabilizing members 16 in that the one or more elongated stabilizing member(s) 16" is/are sized and configured to completely cover the top (or bottom) surface of the base panel assembly 12" in its expanded configuration in the same manner described above with respect to FIG. 6. The medium and/or mechanism used to secure the one or more elongated stabilizing member(s) 16" to the top or bottom surface of the base panel 12" operate(s) to secure the one or more elongated stabilizing member(s) 16" to the base panel assembly 12" sufficiently to lock the individual sub-panels 12A"-12E" together in the expanded, planar configuration of the base panel assembly 12", i.e., such that the sub-panels 12A"-12E" are secured together in the planar configuration of the base panel assembly 12" to form the torsion box panel.

In some embodiments, it may be desirable to secure at least part of the base panel 12, 12', 12" in its fully expanded, i.e., planar, configuration, e.g., as illustrated in FIGS. 2, 3, 9D and 10E, prior to mounting the one or more elongated stabilizing members 16 thereto. Securing the base panel 12, 12', 12" in is fully expanded configuration may serve different individual or common purposes or goals depending upon, for example, the purpose or implementation of the of the panel assembly 10, the environment in which the panel assembly 10 is to be assembled and/or the manner, i.e., steps, in which the panel assembly 10 is to be assembled. In some implementations, as one example, it may be desirable simply to enhance the strength, durability, stiffness and/or rigidity of one or more portions of the base panel 12 and/or of the assembled panel assembly 10. Alternatively or additionally, the panel assembly 10 may require assembly in an environment in which the surface supporting the base panel 12 is not level or planar but is instead uneven, and in such environments one or more hinges of the base panel 12 may not remain fully closed during assembly, thereby compromising the planarity of the base panel 12 and making mounting/application of the one or more stabilizing members 16 thereto difficult, thus resulting in a less than satisfactory assembly 10. Alternatively or additionally still, it may be desirable to fix the base panel 12, in its planar, expanded configuration, in place prior to securing the one or more stabilizing members 16 thereto, e.g., such as in implementations of the assembly 10 in which the base panel 12 is part of a larger assembly. In one particular example, which should not be considered limiting in any way, it may be desirable to arrange multiple base panels 12 side-by-side and to then secure one or more stabilizing members 16 thereto in a manner which overlaps the interfaces between such base panels 12.

At least part of the base panel 12, 12', 12," i.e., two or more pairs of sub-panels of the base panel 12, 12', 12,'" may be secured in a fully expanded, i.e., planar, configuration via one or more braces. An example of one embodiment of a brace is illustrated in FIGS. 2 and 3, and described above, in the form of one or more structural sheets, strips or plates 20A, 20B secured to the top T and/or bottom B surface of the base panel 12, 12', 12" adjacent to at least one terminal end or side of the base panel 12, 12', 12". Alternatively or additionally, one or more braces may be secured between two or more hinged or non-hinged sub-panels to lock such sub-panels together with co-planar top and/or bottom surfaces, and a number of illustrative examples of such braces are illustrated in FIGS. 11-22 and will be described in detail below. It will be understood that in some embodiments in which any of the braces illustrated and described herein are implemented with one or more sub-panels of any of the base panels 12, 12', 12", the one or more stabilizing members 16 may take the form, in whole or in part, of one or more "finish" panels as this term is defined above. It will be further understood that although only a single brace will be described below, in various embodiments, as securing together two adjacent sub-panels, any of the base panels 12, 12', 12" may include any number of such braces for securing two or more, or all, of the sub-panels together.

Figure 11:
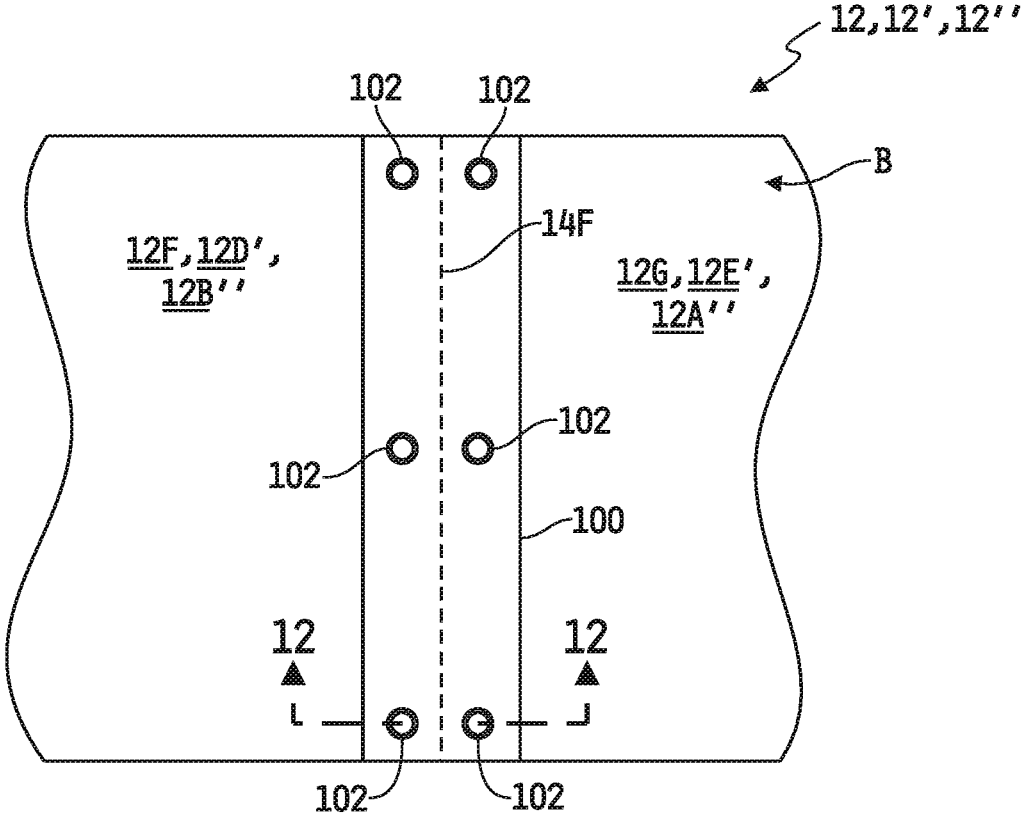
FIG. 11 is a simplified plan view of a portion of any of the base panels of FIGS. 1A-1F, 9A-9D and 10D-10E in its expanded configuration shown with an embodiment of an elongated brace secured to two adjacent sub-panels to lock the two sub-panels together with the planar top surfaces thereof co-planar.
Figure 12:
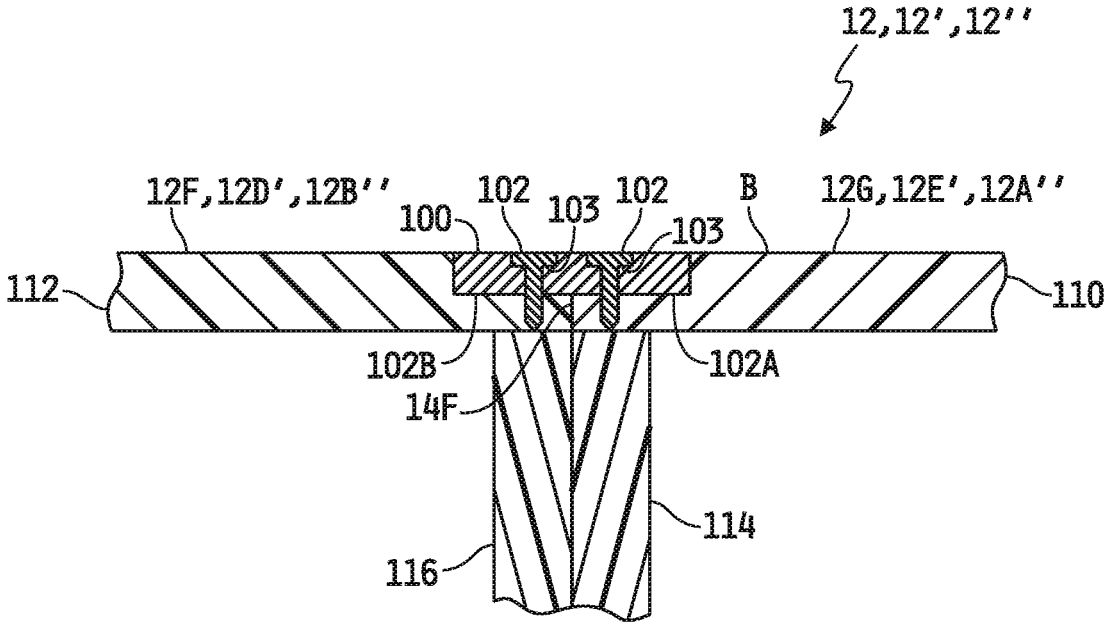
FIG. 12 is a cross-sectional view of the base panel and brace illustrated in FIG. 11 as viewed along section lines 12-12.

Referring now to FIGS. 11 and 12, a portion of any of the base panels 12, 12', 12" in its expanded configuration is shown in which an embodiment of a brace 100 is shown secured to two adjacent sub-panels to lock the sub-panels together with the planar top T surface and/or planar bottom B surface of each sub-panel co-planar. In the illustrated embodiment, the brace 100 is shown secured to two adjacent sub-panels which define the hinge 14F therebetween. In the base panel 12 illustrated in FIGS. 1-8, the sub-panels 12F, 12G defined the hinge 14F therebetween, in the base panel 12' the sub-panels 12D', 12E' define the hinge 14F therebetween and in the base panel 12" the sub-panels 12B", 12A" define the hinge 14F therebetween, as depicted in FIG. 11. As depicted in FIG. 12, the sub-panels 12F, 12E' and 12A" are collectively identified as including a sheet or skin 110 having one major surface defining the bottom surface B of the sub-panel and an opposite major surface secured to the core identified by one of a plurality of ribs 114 thereof, and the sub-panels 12F, 12D' and 12B" are collectively identified as including a sheet or skin 112 having one major surface defining the bottom surface B of the sub-panel and an opposite major surface secured to the core identified by one of a plurality of ribs 116, wherein the hinge 14F is defined at the interfaces of the skins 110, 112 and ribs 114, 116. It will be understood that whereas FIGS. 11 and 12 depict the sub-panels as including the hinge 14F, the brace 100 may alternatively be secured to two adjacent non-hinged sub-panels.

In the embodiment depicted in FIGS. 11 and 12, the brace 100 is provided in the form of an elongated metal strip or plate sized to span the hinge 14F and to span the entire lengths of both sub-panels. In some alternate embodiments, the brace 100 may be sized to span only a portion of the sub-panels, e.g., a middle portion, and in other alternate embodiments the brace 100 may be provided in the form of multiple braces spaced out across the lengths of the sub-panels. In the illustrated embodiment, a channel 120A is formed into the bottom surface B of the skin 110 and another channel 120B is formed into the bottom surface B of the skin 112, and the brace 100 spans the hinge 14F and occupies both channels 120A, 120B. In alternate embodiments, a brace 100 may alternatively or additionally be secured to the top surfaces of the skins 110, 112 across the hinge 14F.

In the illustrated embodiment, the brace 100 is illustratively sized to have a thickness equal to the depths of the channels 120A, 120B such that the planar top surface of the brace 100 is co-planar with the planar bottom surfaces B of the skins 110, 112. In some alternate embodiments, the channels 120A, 120B and/or the brace 100 may be sized such that the planar top surface of the brace 100 is recessed in the channels relative to the bottom surfaces B of the skins 110, 112. In other alternate embodiments, the channels 120A, 120B and/or the brace 100 may be sized such that the planar top surface of the brace 100 is proud of the bottom surfaces B of the skins 110, 112, or the channels 120A, 120B may be omitted altogether. In such embodiments, the one or more stabilizing members and/or finish panels 16 may be suitably notched to clear the top surfaces of the brace(s) 100 if stabilizing members and/or finish panels are to be secured to the same surface as that of the brace(s) 100.

The brace 100 illustrated in FIGS. 11 and 12 illustratively defines a number of bores 102 therethrough along its length, wherein some of the bores 102 are positioned over the skin 110 and others are positioned over the skin 112. Engagement members 103, e.g., screws, are illustratively received within the bores 102 and secured to the skins 110, 112 and, in some embodiments, the rib(s) 114, 116. In some such embodiments, the engagement members 103 may be countersunk as illustrated in FIG. 12 so as to be flush or recessed relative to the top surface of the brace 100, although in other embodiments the engagements members 103 may, when fully secured to the skins 110, 112 and/or ribs 114, 116, remain at least partially proud of the top surface of the brace 100. In some alternate embodiments, the brace 100 may be alternatively or additionally secured to the skins 110, 112 with one or more conventional adhesives or bonding media and/or one or more alternative or additional mechanical fasteners.

Referring now to FIGS. 13-21, a portion of any of the base panels 12, 12', 12" in its expanded configuration is shown in which another embodiment of a brace 160 is shown secured to two adjacent sub-panels to lock the sub-panels together with the planar top T surface and/or planar bottom B surface of each sub-panel co-planar. In the illustrated embodiment, the brace 160 is shown secured to two adjacent sub-panels which define the hinge 14F therebetween, although it will be understood that the brace 160 may alternatively be secured to two adjacent non-hinged sub-panels. The basic forms of the sub-panels are illustratively as described above with respect to FIGS. 11 and 12 and further modified as described below.

Figure 13:
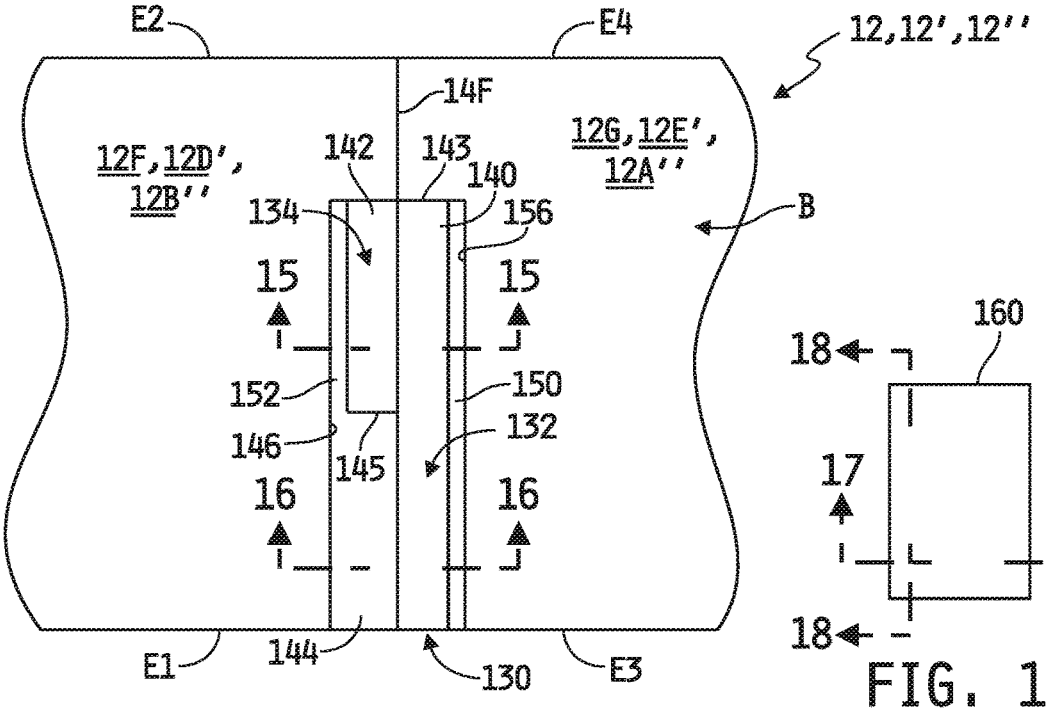
FIG. 13 is a simplified plan view of a portion of any of the base panels of FIGS. 1A-1F, 9A-9D and 10D-10E in its expanded shown configured to receive an embodiment of an elongated brace slidably securable to two adjacent sub-panels to lock the two sub-panels together with the planar top surfaces thereof co-planar.
Figure 15:
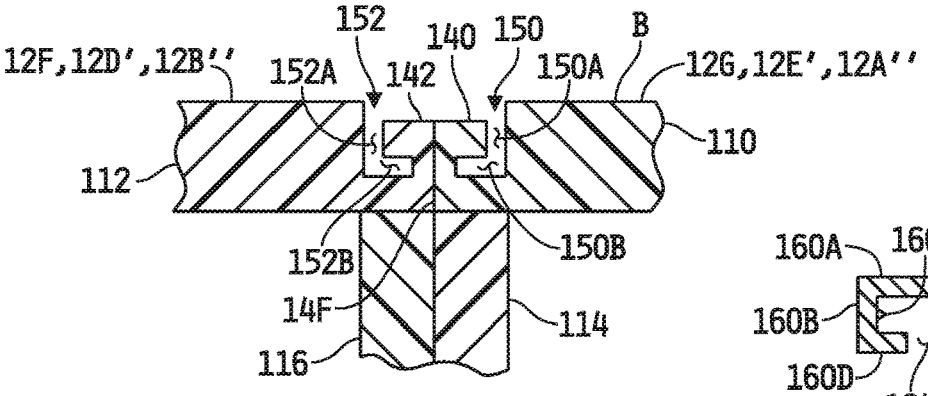
FIG. 15 is a cross-sectional view of the base panel illustrated in FIG. 13 as viewed along section lines 15-15.
Figure 16:
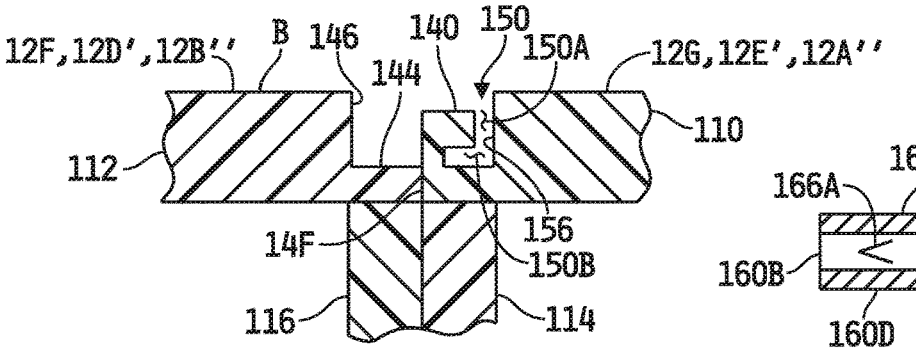
FIG. 16 is a cross-sectional view of the base panel illustrated in FIG. 13 as viewed along section lines 16-16.

Referring to FIGS. 13, 15 and 16, the sub-panels illustratively define a channel structure 130 configured to receive the brace 160 therein and to slidingly engage the brace 160 to secure the two sub-panels together. The channel structure 130 illustratively includes a channel structure 132 defined on one of the sub-panels 12G, 12E', 12A" and a channel structure 134 defined on the other sub-panel 12F, 12D', 12B//. The channel structure 132 is illustratively configured to retain the brace 160 on the respective sub-panel prior to securing the two sub-panels together and further to allow sliding movement of the brace 160 relative thereto. With the brace 160 retained within the channel structure 132, the respective sub-panel 12G, 12E', 12A" carries the brace 160 prior to, during and after assembly of the torsion box panel 10, and the brace 160 is accordingly carried by the base panel 12 in its compact configuration as well as its expanded configuration. The channel structure 134 is illustratively configured to slidingly receive the brace 160 when the two respective sub-panels are folded together or otherwise arranged with their respective bottom surfaces B (and/or top surfaces T) substantially co-planar so as to secure together with the brace 160 the two sub-panels with their respective bottom B and top T surfaces co-planar.

The channel structure 134 is illustratively an elongated channel structure having two different sections axially separated from one another. The channel structure 134 illustratively extends from one end E1 of the sub-panel 12F, 12D', 12B" toward the opposite end E2, but terminates short of the end E2 at a wall 143 spaced apart from the end E2. Between the wall 143 and the end E2 of the channel structure 134, the channel structure 134 illustratively defines a planar recessed surface 142 which extends from the wall 143 axially toward the end E1 of the sub-panel, but terminates short of the end E1 at a wall 145 spaced apart from the end E1. At the wall 145, the recessed surface 142 illustratively drops to another planar recessed surface 144 which is deeper than that of the recessed surface 142. The recessed surface 144 illustratively extends axially to and through the end E1 of the sub-panel, and extends transversely from a wall 146 to the open end of the hinge 14F. Between the wall 145 and the wall 143, the channel structure 134 further defines an elongated channel 152 which extends transversely between the wall 146 and the recessed surface 144. In the illustrated embodiment, the channel 152 is C-shaped and includes a vertically-extending (relative to the bottom surface B of the respective sub-panel) channel portion 152A intersecting a horizontally-extending portion 152B which extends toward, but terminates short of, the opening of the hinge 14F.

The channel structure 132 is likewise illustratively an elongated channel structure but includes only a single channel section. The channel structure 132 illustratively extends from one end E3 of the sub-panel 12G, 12E', 12A", which is illustratively flush with the end E1 of the sub-panel 12F, 12D', 12B", toward the opposite end E4, but terminates short of the end E4 at the wall 143. Between the wall 143 and the end E3 of the channel structure 132, the channel structure 132 illustratively defines a planar recessed surface 140 which extends from the wall 143 axially to and through the end E3 of the respective sub-panel. Between the wall 143 and the end E3, the channel structure 132 further defines an elongated channel 150 which extends transversely between a wall 156 and the recessed surface 140. In the illustrated embodiment, the channel 150 is likewise C-shaped and includes a vertically-extending (relative to the bottom surface B of the respective sub-panel) channel portion 150A intersecting a horizontally-extending portion 150B which extends toward, but terminates short of, the opening of the hinge 14F.

Figure 14:
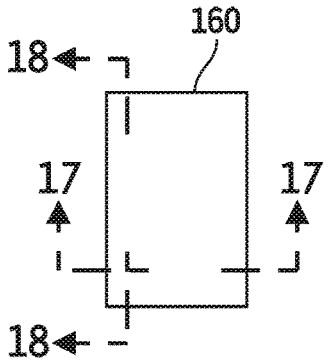
FIG. 14 is a simplified plan view of an embodiment of an elongated brace configured to slidably secure together the two adjacent sub-panels illustrated in FIG. 13.
Figure 17:
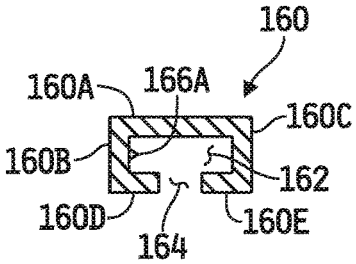
FIG. 17 is a cross-sectional view of the elongated brace illustrated in FIG. 14 as viewed along section lines 17-17.
Figure 18:
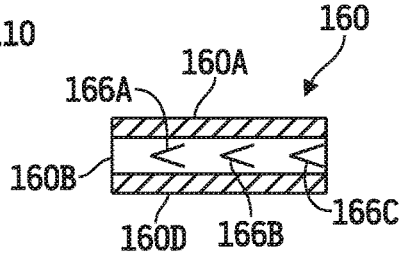
FIG. 18 is a cross-sectional view of the elongated brace illustrated in FIG. 14 as viewed along section lines 18-18.

Referring now to FIGS. 14, 17 and 18, the brace 160 is illustratively a C-shaped brace having a planar top member 160A, opposed legs 160B, 160C extending normally away from respective opposite ends of the planar top member 160A and inwardly facing feet or tabs 160D, 160E extending normally away from the ends of the respective legs 160B, 160C. The terminal ends of the feet 160D, 160E are spaced apart from one another by a space 164, and the brace 160 defines an internal volume 162. In some embodiments, as illustrated by example in FIGS. 16 and 17, the inner wall of at least one leg 160B defines a number of teeth 166A, 166B, 166C oriented to allow the brace 160 to slide relative to the vertically oriented wall of the recessed surface 142 of the channel structure 132 in the direction of the wall 143 but to engage the vertically oriented wall of the recessed surface 142 and lock the brace 160 relative thereto when the brace 160 is moved in the opposite direction. Once received axially within the channel 152, the teeth 166A, 166B, 166C thus serve to secure the brace 160 in place so that it cannot thereafter slide out of the channel 152 in the direction of the end E1 of the respective sub-panel. In alternate embodiments, the teeth 166A-166C may be omitted and the brace 160 may be secured to the sub-panel 12F, 12D', 12B" with one or more conventional adhesives, one or more conventional bonding media and/or one or more conventional mechanical fasteners. In any case, it will be understood that the dimensions of the various components of the brace 160 are sized to match those of the channel structure 130 such that the leg 160B and foot 160D may be slidably received within the respective channel portions 152A, 152B of the channel 152, and such that the leg 160C and foot 160E may be slidably received within the respective channel portions 150A, 150B of the channel 150.

Figure 19A:
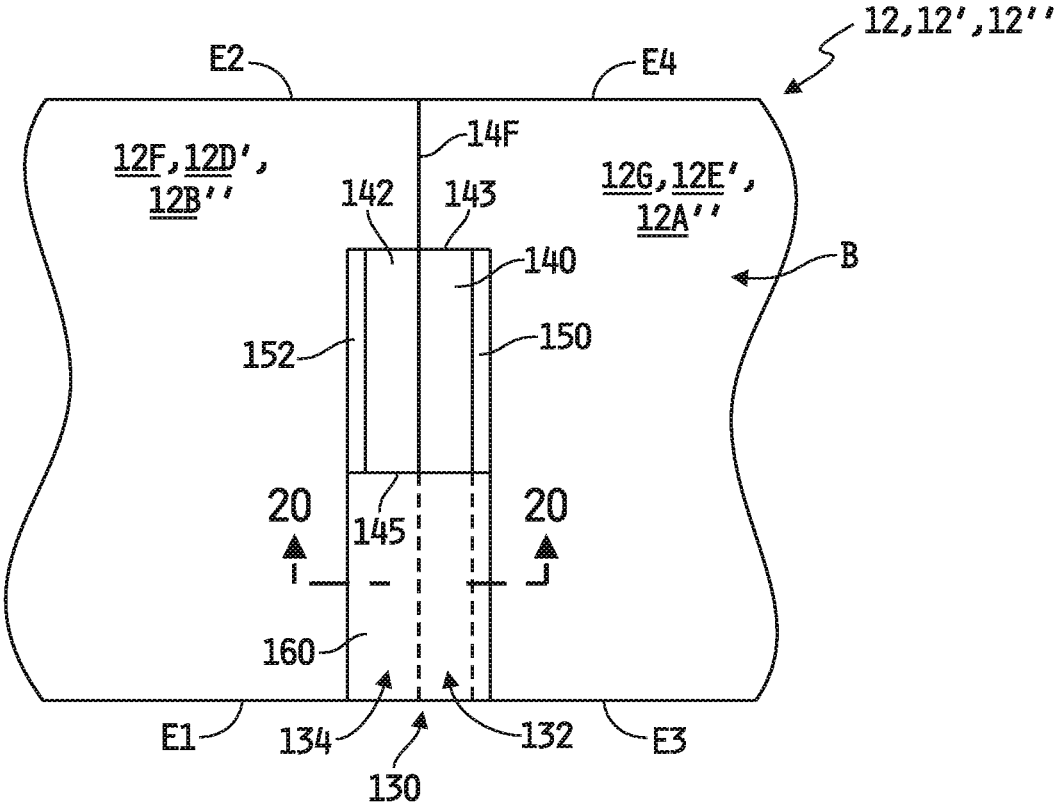
FIG. 19A is a simplified plan view of the base panel of FIG. 13 shown with the elongated brace of FIG. 14 in a non-locking position of the brace relative to the two adjacent sub-panels.

Referring now to FIGS. 19A and 19B, 20 and 21 engagement of the brace 160 with the sub-panels is illustrated. The brace 160 is first received only within the channel structure 132 adjacent to the sub-panel end E3 and advanced toward the wall 143. The brace 160 engages the channel structure 132 via engagement of the leg 160C and foot 160E of the brace 160 with the respective channel portions 150A, 150B of the channel 150 as illustrated by example in FIG. 21. In some embodiments, the end E3 of the sub-panel 12G, 12E', 12A" may thereafter be capped so that the brace 160 will not slide out of the channel structure 132. The sub-panel 12G, 12E', 12A" may then carry the brace 160 in any configuration of the base panel 12, 12', 12" without disengaging and potentially losing the brace 160 prior to assembly of the torsion box panel 10. In any case, the axial length of the brace 160 matches, or is less than, that of the portion of the channel structure 134 defined between the end E1 of the sub-panel and the wall 145, as illustrated in FIG. 19A, so that the brace 160 may be received therein when the respective sub-panels are folded or brought together. Thus, with the brace 160 positioned adjacent to the end E3 of the sub-panel, the adjacent sub-panels may be repeatedly folded about the hinge 14F (or separated from one another in non-hinged embodiments) because the portion of the channel structure 134 defined between the end E1 of the sub-panel and the wall 145 is devoid of any structure which may engage the brace 160, as most clearly illustrated in FIG. 20.

Figure 19B:
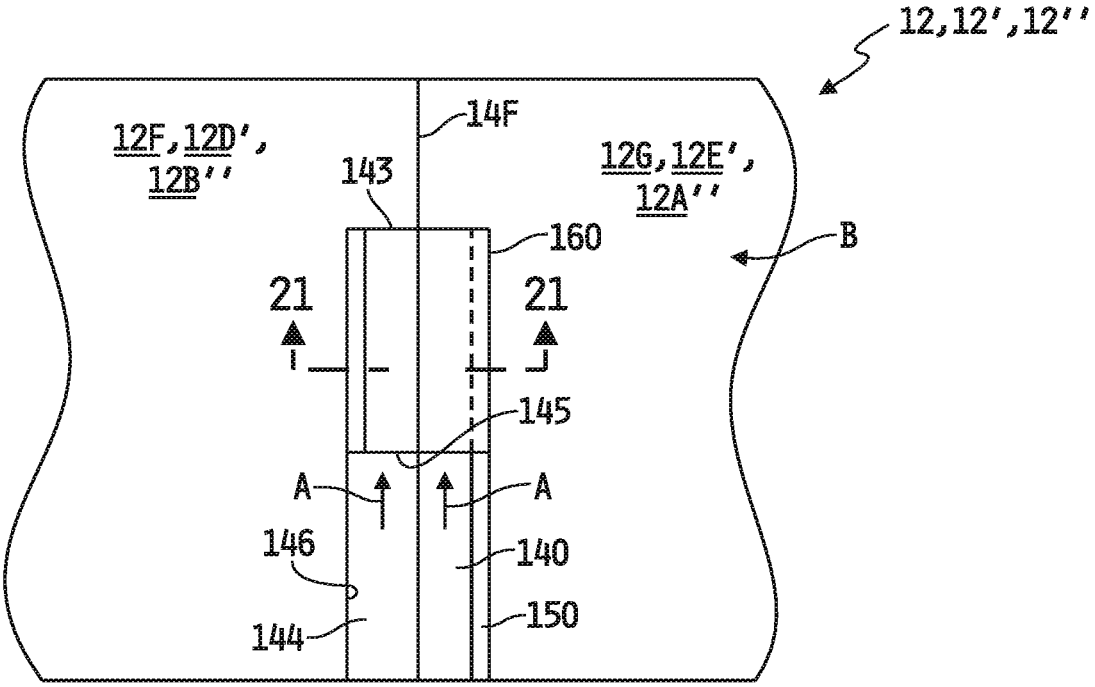
FIG. 19B is a simplified plan view similar to FIG. 19A with the elongated brace moved to a locking position thereof relative to the two adjacent sub-panels in which the elongated brace is secured to both sub-panels to lock the two sub-panels together with the planar top surfaces thereof co-planar.
Figure 20:
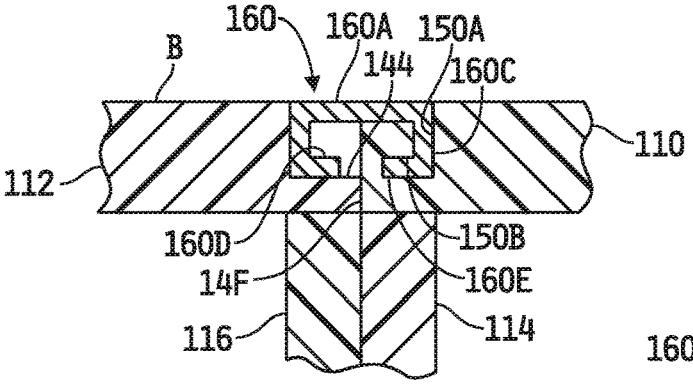
FIG. 20 is a cross-sectional view of the base panel and brace illustrated in FIG. 19A as viewed along section lines 20-20.
Figure 21:
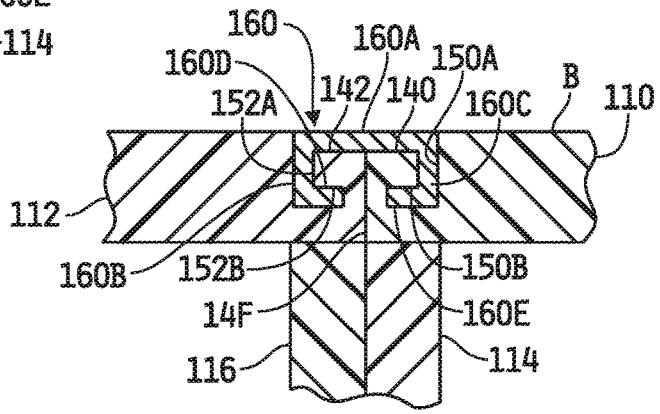
FIG. 21 is a cross-sectional view of the base panel and brace illustrated in FIG. 19B as viewed along section lines 21-21.

As depicted in FIG. 19B, the brace 160 the adjacent sub-panels are secured together with their respective bottom surfaces B co-planar by sliding the brace 160 from the position illustrated in FIG. 19A toward and to the wall 143. As the brace 160 clears the wall 145 of the channel structure 134, the brace 160 engages the channel structure 134 via engagement of the leg 160B and foot 160D of the brace 160 with the respective channel portions 152A, 152B of the channel 152 as illustrated by example in FIG. 21. In some embodiments, the brace 160 is secured, i.e., locked, in the position illustrated in FIGS. 19B and 21 via operation of the teeth 166A-166C as described above. Alternatively or additionally, other conventional structures and/or techniques may be used to lock the brace 160 in the engaged position as also described above.

In the illustrated embodiment, the brace 160 and the channel structure 130 are sized such that the planar top surface of the brace 160 is co-planar with the bottom surfaces B of the respective sub-panels when the brace 160 is received within the channel structure 130. In some alternate embodiments, the channel structure 130 and/or the brace 160 may be sized such that the planar top surface of the brace 160 is recessed in the channel structure 130 relative to the bottom surfaces B of the skins 110, 112 of the respective sub-panels. In other alternate embodiments, the channel structure 130 and/or the brace 160 may be sized such that the planar top surface of the brace 160 is proud of the bottom surfaces B of the skins 110, 112 of the respective sub-panels. In such embodiments, the one or more stabilizing members and/or finish panels 16 may be suitably notched to clear the top surfaces of the brace(s) 160 if stabilizing members and/or finish panels are to be secured to the same surface as that of the brace(s) 160.

Figure 22:
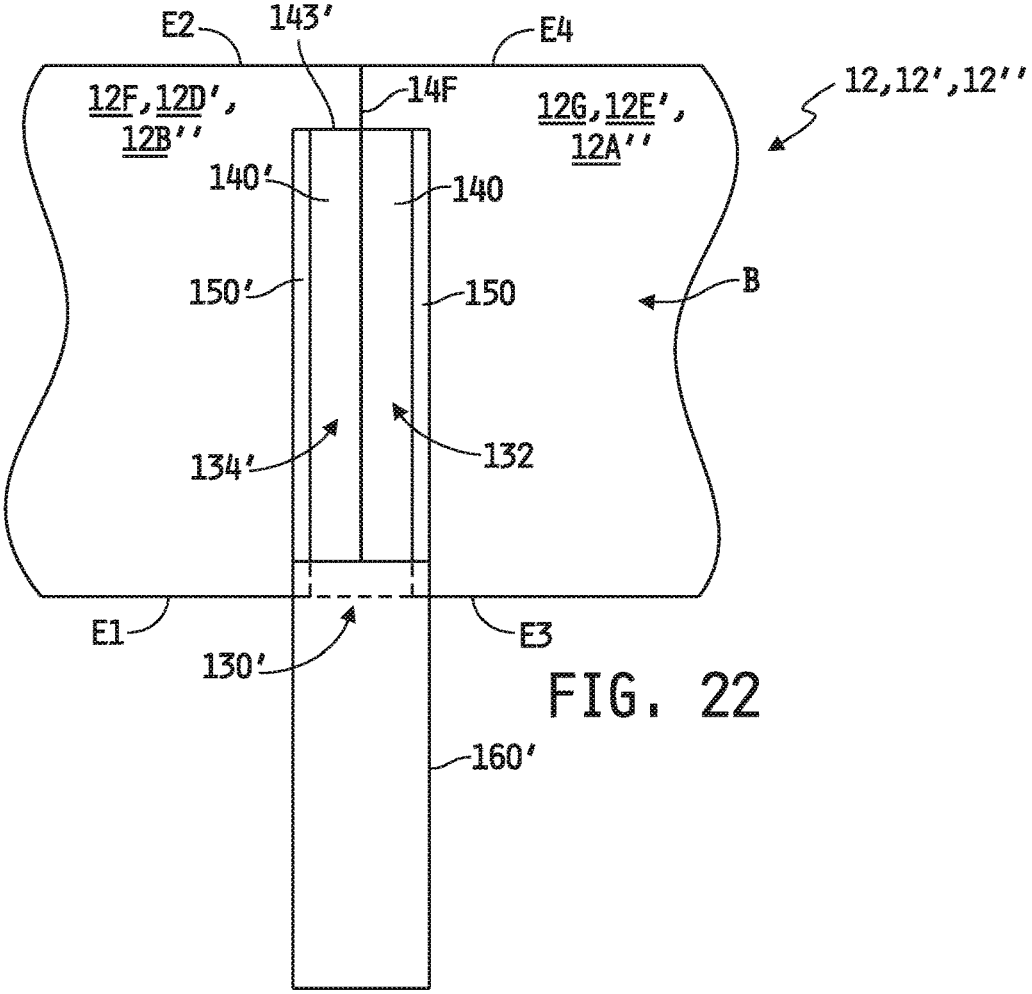
FIG. 22 is a simplified plan view of a portion of any of the base panels of FIGS. 1A-1F, 9A-9D and 10D-10E in its expanded shown configured to receive another embodiment of an elongated brace slidably securable to two adjacent sub-panels to lock the two sub-panels together with the planar top surfaces thereof co-planar.

Referring now to FIG. 22, a portion of any of the base panels 12, 12', 12" in its expanded configuration is shown in which yet another embodiment of a brace 160' is shown secured to two adjacent sub-panels to lock the sub-panels together with the planar top T surface and/or planar bottom B surface of each sub-panel co-planar. In the illustrated embodiment, the brace 160' is shown secured to two adjacent sub-panels which define the hinge 14F therebetween, although it will be understood that the brace 160' may alternatively be secured to two adjacent non-hinged sub-panels.

The brace 160' is illustratively identical to the brace 160 illustrated in FIGS. 13-21 with the exception that the brace 160' is an elongated form of the brace 160. The channel structure 130' is identical in part to the channel structure 130 illustrated in FIGS. 13-21 in that the channel structure 132 depicted in FIG. 22 is identical to that depicted in FIGS. 13-21. The channel structure 134' differs from the channel structure 134 depicted in FIG. 13-21 in that the channel structure 134' is the mirror image of the channel structure 132, i.e., it includes a recessed surface 140' identical to the recessed surface 140 of the channel structure 132 and a channel 150' identical to the channel 150 of the channel structure 132.

In the embodiment illustrated in FIG. 22, the brace 160 is separate from the respective sub-panels. To secure the respective sub-panels together with their respective top T and bottom B surfaces co-planar, they are first arranged side-by-side so that their bottom B and top T surfaces are co-planar, e.g., by folding the respective sub-panels about the hinge 14F or otherwise bringing the respective sub-panels together as shown. The brace 160 is then introduced into the end of the channel structure 130' adjacent to the ends E1, E3 of the respective sub-panels, and then advanced toward and to the terminal wall 143' of the channel structure 130'. In the illustrated embodiment, the terminal wall 143' is spaced apart from the ends E2, E4 of the respective sub-panels. In some alternate embodiments, the terminal wall 143' may be closer to or further from the ends E2, E4, and in other alternate embodiments the terminal wall 143' may be omitted and the channel structure 130' may extend to the ends E2, E4 of the respective sub-panels. The brace 160' in such embodiments may extend the length of the channel structure 130' or may instead occupy only a portion of the channel structure 130'. In still other embodiments, the brace 160' may be replaced with one or more shorter braces 160'. In some embodiments, the brace 160' is secured, i.e., locked, in position via inclusion and operation of one or more teeth 166A-166C as illustrated in FIGS. 17 and 18 and described above. Alternatively or additionally, other conventional structures and/or techniques may be used to lock the brace 160' in the engaged position within the channel structure 130'.

In each of the embodiments illustrated in FIGS. 11-22, the various braces 100, 160, 160' are shown and described above as being elongated structures oriented axially parallel with, e.g., over, the hinges and/or adjacent sides (lengths) of one or more of the sub-panels. It will be understood, however, that such structures are shown and described only by way of example and should not be considered to be limiting in any way. In this regard, it will be further understood that this disclosure contemplates embodiments in which one or more of the braces 100, 160, 160' may alternatively be axially oriented so as to be perpendicular to, and span, one or more of the hinges and/or adjacent sides of one or more of the sub-panels. In other alternate embodiments, one or more of the braces 100, 160, 160' may be axially oriented to form any angle with respect to the respective hinge(s) and/or sub-panel sides. Further still, in any embodiment illustrated and/or described herein, one or more of the braces 100, 160, 160' may be provided in the form of multiple braces, e.g., arranged parallel with or perpendicular to one another and/or arrange to form any angle(s) relative to one another. In any embodiment, one or more of the braces 100, 160, 160' may be at least partially non-linear and/or at least partially piecewise linear. Further still, while embodiments are shown and described in which the sub-panel channels and respective ones of the braces 100, 160, 160' are configured to be flat or C-shaped structures, it will be understood that this disclosure contemplates embodiments in which such channels and respective braces 100, 160, 160' have other channel and respective brace configurations.

While the disclosure has been illustrated and described in detail in the drawings and foregoing description, such an illustration and description is to be considered as exemplary and not restrictive in character, it being understood that only illustrative embodiments have been shown and described and that all changes and modifications consistent with the disclosure and recited claims are desired to be protected.

What is claimed is:

1. A torsion box panel assembly, comprising:

a plurality of sub-panels each defining a respective sub-panel length and sub-panel width and each including a first skin having opposed first and second surfaces and a core secured to the first surface of the first skin with the second surface of the secured first skin being planar, a plurality of hinges each coupled between a different pair of the plurality of sub-panels and extending at least partially along the sub-panel lengths thereof, each of the plurality of sub-panels foldable relative to an adjacent one of the plurality of sub-panels along a respective one of the plurality of hinges, wherein the plurality of hingedly-coupled sub-panels forms a base panel having an expanded configuration in which each of the plurality of hinges is closed and the second planar surfaces of the first skins of all of the plurality of sub-panels are substantially co-planar, the base panel in the expanded configuration having a base panel width defined by individual lengths of each the plurality of sub-panels, a base panel length defined, at least in part, by a sum of the widths of each of the plurality of sub-panels and a first planar panel surface defined, at least in part, by a combination of the co-planar second planar surfaces of the first skins of each of the plurality of sub-panels, and a plurality of rigid stabilizing panel members attached to and covering entirely the co-planar second surfaces of the first skins of all of the plurality of subpanels in the expanded configuration of the base panel, the attached plurality of rigid stabilizing panel members being co-planar with one another and spanning all of the plurality of closed hinges to lock the plurality of sub-panels together in the expanded configuration of the base panel to form a torsion box panel.

2. The torsion box panel assembly of claim 1, wherein at least one of the plurality of hinges comprises a hinge member secured to each one of a respective pair of the plurality of subpanels.

3. The torsion box panel assembly of claim 2, wherein the hinge member is a flexible hinge member.

4. The torsion box panel assembly of claim 1, wherein the core of each of the plurality of sub-panels has a first surface secured to the first surface of the first respective skin and a second planar surface opposite the first surface of the core of the sub-panel, and wherein, in the expanded configuration of the base panel, the second planar surfaces of the cores of all of the plurality of sub-panels are substantially co-planar, and wherein the base panel, in the expanded configuration, has a second planar panel surface opposite the first planar panel surface and defined, at least in part, by a combination of the co-planar second planar surfaces of the cores of each of the plurality of sub-panels.

5. The torsion box panel assembly of claim 4, further comprising at least one elongated panel secured to the second planar panel surface of the base panel in the expanded configuration.

6. The torsion box panel assembly of claim 4, further comprising a brace secured to each of a respective pair of the plurality of sub-panels in the expanded configuration of the base panel, the brace extending at least partially along the sub-panel lengths of the respective pair of the plurality of sub-panels, the brace maintaining the second surfaces of the respective pair of the plurality of sub-panels substantially co-planar and preventing a respective closed one of the plurality of hinges from opening.

7. The torsion box panel assembly of claim 1, wherein each of the plurality of hinges comprises an open end and a closed end, opposite the open end, about which at least one of a respective pair of the plurality of sub-panels folds relative to the other as the hinge opens and closes, wherein the first skins of all of the plurality of sub-panels are together formed of a single, continuous, at least semi-flexible skin extending the length of the base panel, and wherein the closed ends of the plurality of hinges each comprise a portion of the single, continuous skin extending along the sub-panel lengths between a respective pair of the plurality of sub-panels.

8. The torsion box panel assembly of claim 1, wherein each of the plurality of sub-panels further include a second skin having a first surface secured to the core and a second planar surface opposite the secured first surface of the second skin, such that the first surfaces of the first and second skins are spaced apart by the core.

9. The torsion box panel assembly of claim 8, wherein each of the plurality of hinges comprises an open end and a closed end, opposite the open end, about which at least one of a respective pair of the plurality of sub-panels folds relative to the other as the hinge opens and closes, wherein the open ends of the plurality of hinges each comprise at least adjacent or abutting sides of the second skins extending along the sub-panel lengths of a respective pair of the plurality of sub-panels.

10. The torsion box panel assembly of claim 9, wherein the closed ends of the plurality of hinges each comprise a hinge member secured to each one of a respective pair of the plurality of subpanels opposite the open end of the respective hinge.

11. The torsion box panel assembly of claim 10, wherein at least one of the hinge members is a flexible hinge member.

12. The torsion box panel assembly of claim 9, wherein the first skins of all of the plurality of sub-panels are together formed of a single, continuous, at least semi-flexible skin extending the length of the base panel, and wherein the closed ends of the plurality of hinges each comprise a portion of the single, continuous skin extending along the sub-panel lengths between a respective pair of the plurality of sub-panels.

13. The torsion box panel assembly of claim 8, wherein, in the expanded configuration of the base panel, the second planar surfaces of the second skins of all of the plurality of sub-panels are substantially co-planar, and wherein the base panel, in the expanded configuration, has a second planar panel surface opposite the first planar panel surface and defined, at least in part, by a combination of the co-planar second planar surfaces of the second skins of each of the plurality of sub-panels.

14. The torsion box panel assembly of claim 13, further comprising at least one panel secured to the second planar panel surface of the base panel in the expanded configuration.

15. The torsion box panel assembly of claim 13, further comprising a brace secured to each of the second skins of a respective pair of the plurality of sub-panels in the expanded configuration of the base panel, the brace extending at least partially along the sub-panel lengths of the respective pair of the plurality of sub-panels, the brace maintaining the second surfaces of the first skins of the respective pair of the plurality of sub-panels substantially co-planar and preventing a respective closed one of the plurality of hinges from opening.

16. The torsion box panel assembly of claim 1, wherein the base panel further has a compact configuration for transportation or storage of at least the base panel prior to attaching the plurality of rigid stabilizing panel members to the first planar panel surface thereof, and wherein at least one of a hinged pair of the plurality of sub-panels is folded relative to the other along an at least partially open respective one of the plurality of hinges in the compact configuration of the base panel.

17. A torsion box panel assembly, comprising:

a plurality of sub-panels each defining a respective sub-panel length and sub-panel width and each including a first skin having opposed first and second surfaces and a core secured to the first surface of the first skin with the second surface of the secured first skin being planar, a plurality of hinges each coupled between a different pair of the plurality of sub-panels and extending at least partially along the sub-panel lengths thereof, each of the plurality of sub-panels foldable relative to an adjacent one of the plurality of sub-panels along a respective one of the plurality of hinges, wherein the plurality of hingedly-coupled sub-panels forms a base panel having an expanded configuration in which each of the plurality of hinges is closed and the second planar surfaces of the first skins of all of the plurality of sub-panels are substantially co-planar, the base panel in the expanded configuration having a base panel width defined by individual lengths of each the plurality of sub-panels, a base panel length defined, at least in part, by a sum of the widths of each of the plurality of sub-panels and a first planar panel surface defined, at least in part, by a combination of the co-planar second planar surfaces of the first skins of each of the plurality of sub-panels, and at least one stabilizing member secured to the first planar panel surface of the base panel in the expanded configuration, the secured at least one stabilizing member spanning all of the plurality of closed hinges to lock the plurality of sub-panels together to form a torsion box panel, wherein the base panel further has a compact configuration for transportation or storage of at least the base panel prior to securing the at least one stabilizing member to the first planar panel surface thereof, wherein at least one of a hinged pair of the plurality of sub-panels is folded relative to the other along an at least partially open respective one of the plurality of hinges in the compact configuration of the base pane, wherein, in the compact configuration of the base panel, at least one sub-panel of at least two hinged pairs of the plurality of sub-panels is folded relative to the other along at least partially open respective ones of the plurality of hinges such that at least three of the plurality of sub-panels form a pocket therebetween, the pocket sized to receive and contain therein the at least one stabilizing member, and wherein, with the base panel in the compact configuration, the at least one stabilizing member is disposed in the pocket for transportation or storage thereof together with the base panel.

18. The torsion box panel assembly of claim 1, wherein the plurality of rigid stabilizing panel members comprises a plurality of decorative panels each attached to and together covering entirely the first planar surface of the base panel, the plurality of decorative panels having lengths extending parallel with the base panel length, at least some of the plurality of decorative panels spanning one or more of the plurality of hinges and the plurality of decorative panels together spanning all of the plurality of hinges.

19. The torsion box panel assembly of claim 1, wherein the plurality of rigid stabilizing panel members comprises a plurality of wood panels each attached to and together covering entirely the first planar surface of the base panel, the plurality of wood panels having lengths extending parallel with the base panel length, at least some of the plurality of wood panels spanning one or more of the plurality of hinges and the plurality of wood panels together spanning all of the plurality of hinges.

20. The torsion box panel assembly of claim 19, wherein the plurality of wood panels comprises a plurality of wood veneers.

* * * * *